US009653815B2

(12) United States Patent
Liu et al.

(10) Patent No.: US 9,653,815 B2
(45) Date of Patent: May 16, 2017

(54) METAMATERIAL, METAMATERIAL PREPARATION METHOD AND METAMATERIAL DESIGN METHOD

(71) Applicant: KUANG-CHI INNOVATIVE TECHNOLOGY LTD., Shenzhen (CN)

(72) Inventors: Ruopeng Liu, Shenzhen (CN); Zhiya Zhao, Shenzhen (CN); Jing Jin, Shenzhen (CN)

(73) Assignee: KUANG-CHI INNOVATIVE TECHNOLOGY LTD., Shenzhen (CN)

( * ) Notice: Subject to any disclaimer, the term of this patent is extended or adjusted under 35 U.S.C. 154(b) by 27 days.

(21) Appl. No.: 14/716,891

(22) Filed: May 20, 2015

(65) Prior Publication Data

US 2015/0255877 A1 Sep. 10, 2015

Related U.S. Application Data

(63) Continuation of application No. PCT/CN2013/085815, filed on Oct. 23, 2013.

(30) Foreign Application Priority Data

Nov. 20, 2012 (CN) ..... 2012 1 0470377
Nov. 20, 2012 (CN) ..... 2012 1 0470387
Nov. 20, 2012 (CN) ..... 2012 1 0470406

(51) Int. Cl.
*H01Q 15/00* (2006.01)
*H01Q 1/42* (2006.01)
(Continued)

(52) U.S. Cl.
CPC ..... *H01Q 15/0086* (2013.01); *H01Q 1/425* (2013.01); *H01Q 15/0006* (2013.01);
(Continued)

(58) Field of Classification Search
USPC ..... 341/909
See application file for complete search history.

(56) References Cited

U.S. PATENT DOCUMENTS 4,905,014 A * 2/1990 Gonzalez ..... H01Q 3/46 343/700 MS
5,400,043 A 3/1995 Arceneaux et al.
(Continued)

FOREIGN PATENT DOCUMENTS

CN 102480046 A 5/2012
CN 102480049 A 5/2012
(Continued)

*Primary Examiner* — Howard Williams
(74) *Attorney, Agent, or Firm* — Perkins Coie LLP

(57) ABSTRACT

The present invention discloses a metamaterial, a metamaterial preparation method, and a metamaterial design method. The metamaterial includes: at least one layer of substrate and multiple artificial microstructures, where the metamaterial includes an electromagnetic area, and an artificial microstructure in the electromagnetic area generates a preset electromagnetic response to an electromagnetic wave that is incident into the electromagnetic area. Due to a simple making process, a low processing cost, and simple craft precision control, the metamaterial according to the present invention may replace various mechanical parts that have complicated curved surfaces and need to have a specific electromagnetic modulation function, and may also be attached onto various mechanical parts that have complicated curved surfaces to implement a desired electromagnetic modulation function. In addition, by expanding a curved surface and division into electromagnetic areas, a three-dimensional structure metamaterial has a high electromagnetic responsivity and a wide application scope.

19 Claims, 14 Drawing Sheets

(51) Int. Cl.

| | |
|---|---|
| ***H01Q 15/02*** | (2006.01) |
| ***H01Q 17/00*** | (2006.01) |
| ***H01Q 1/40*** | (2006.01) |

(52) U.S. Cl.

CPC ..... *H01Q 15/02* (2013.01); *H01Q 1/40* (2013.01); *H01Q 1/422* (2013.01); *H01Q 17/002* (2013.01); *Y10T 29/49016* (2015.01)

(56) References Cited

U.S. PATENT DOCUMENTS

| | | | | |
|---|---|---|---|---|
| 6,545,645 | B1 * | 4/2003 | Wu | H01Q 19/104 343/781 CA |
| 7,570,432 | B1 | 8/2009 | Yonak | |
| 8,253,639 | B2 * | 8/2012 | Cohen | H01P 1/20 343/753 |
| 8,350,777 | B2 * | 1/2013 | Morton | H01Q 1/42 343/872 |
| 2010/0225562 | A1 | 9/2010 | Smith | |

FOREIGN PATENT DOCUMENTS

| | | | |
|---|---|---|---|
| CN | 102480050 | A | 5/2012 |
| CN | 102480056 | A | 5/2012 |
| CN | 102480846 | A | 5/2012 |
| CN | 102570044 | A | 7/2012 |
| CN | 102637952 | A | 8/2012 |
| CN | 102637953 | A | 8/2012 |
| CN | 102709702 | A | 10/2012 |
| EP | 2463515 | A1 | 6/2012 |
| GB | 2432261 | A | 5/2007 |

* cited by examiner

METAMATERIAL, METAMATERIAL PREPARATION METHOD AND METAMATERIAL DESIGN METHOD

CROSS REFERENCE TO RELATED APPLICATIONS

This application is a continuation of PCT Application No. PCT/CN2013/085815 filed on Oct. 23, 2013, which claims priority to Chinese patent application No. 201210470406.7 filed Nov. 20, 2012; Chinese patent application No. 201210470387.8 filed Nov. 20, 2012; and Chinese patent application No. 201210470377.4 filed Nov. 20, 2012; all of which are incorporated by reference.

TECHNICAL FIELD

The present application relates to a metamaterial, a metamaterial preparation method, and a metamaterial design method.

BACKGROUND

A metamaterial is a new artificial material that emerges in the past decade and generates a modulation effect on an electromagnetic wave. Basic principles of the metamaterial are to design a microstructure (or called an artificial "atom") of a material artificially, and grant specific electromagnetic characteristics to such a microstructure. In this way, a material made of a massive number of microstructures may macroscopically have an electromagnetic function desired by people. Different from a conventional material technology in which a way of using electromagnetism is developed according to natural properties of an existing material in the nature, a metamaterial technology designs properties of a material artificially and makes a material as required. A metamaterial generally lets a specific number of artificial microstructures be attached to a substrate that is somewhat mechanical and electromagnetic. Such microstructures of a specific pattern and a specific material generate a modulation effect on an electromagnetic wave that passes through the microstructures and has a specific band.

Conventional metamaterials, for example, an American patent "METAMATERIAL GRADIENT INDEX LENS" whose disclosure number is "U.S. Pat. No. 7,570,432B1", an American patent "BROADBAND METAMATERIAL APPARATUS, METHODS, SYSTEMS, AND COMPUTER READABLE MEDIA" whose disclosure number is "US2010/0225562A1", are generated by attaching microstructures onto a substrate of a panel. In preparing a panel metamaterial, a processing process of attaching microstructures onto a substrate is relatively simple, and a processing process applied in a conventional PCB board field may be used, for example, etching, diamond etching, ion etching, and electroetching. A panel-shaped metamaterial has merits of miniaturization and thinness, but it restricts an application scope of the metamaterial.

Responsivity of a conventional metamaterial to an electromagnetic wave is largely decided by microstructures. However, when the metamaterial needs to respond to some electromagnetic waves that have a relative wide span of an electromagnetic parameter range to implement specific functions, for example, when a wave-transmissive effect is required for all electromagnetic waves with incident angle from 0 to 90°, or when polarization conversion needs to be implemented for all electromagnetic waves with polarization angle from 0 to 90°, because the responsivity of the microstructures to electromagnetic waves has a limit value, it is rather difficult or even impracticable to obtain a desired metamaterial by using a conventional metamaterial design method, for example, by emulating a specific microstructure and changing its topological structure or dimensions or the like.

When the metamaterial needs to be made into a curved surface, the processing process of microstructures of the curved surface is difficult and precision is not high. For example, difficulty of preparation becomes very high when a processing process in a conventional PCB board field is applied. For example, an existing European patent whose application number is "EP0575848A2" discloses a method for processing a metal microstructure on a three-dimensional curved surface, and its detailed implementation manner is: etching microstructures one by one by means of exposure and imaging performed with a laser sensor. In such a manner, both processing costs and craft precision control costs are high, which makes it impracticable to implement fast and massive production.

SUMMARY

A technical issue to be solved in a first aspect of the disclosure is to put forward a three-dimensional structure metamaterial with a simple processing process and an optimal electromagnetic response effect in view of disadvantages of the prior art.

A technical solution of the technical issue to be solved in an first aspect of the disclosure is to put forward a three-dimensional structure metamaterial, which includes: at least one layer of formed substrate, and at least one flexible function layer, where the flexible function layer is disposed on a surface of the formed substrate or disposed between multiple layers of formed substrates; each flexible function layer includes a flexible substrate formed of at least one flexible subsubstrate and multiple artificial microstructures that are disposed on each flexible subsubstrate and capable of responding to an electromagnetic wave, and the three-dimensional structure metamaterial has an electromagnetic wave modulation function.

Further, the three-dimensional structure metamaterial includes at least two flexible function layers and at least two layers of the formed substrate.

Further, the three-dimensional structure metamaterial includes at least three flexible function layers and at least three layers of the formed substrate.

Further, the formed substrate and the flexible function layer are spaced alternatively.

Further, each flexible substrate is disposed in a close-fitting manner, and the flexible function layer fits the surface of the formed substrate closely.

Further, the flexible substrate is a thermoplastic material or a thermoplastic composite material with flexible fibers.

Further, a material of the flexible substrate is a polyimide, polyester, polytetrafluoroethylene, polyurethane, polyarylate, PET film, PE film or PVC film.

Further, the three-dimensional structure metamaterial can implement electromagnetic wave modulation functions such as wave transmission, wave absorbing, beam forming, polarization conversion or directivity pattern modulation for the electromagnetic wave.

Further, the three-dimensional structure metamaterial can implement frequency-selective wave transmission, frequency-selective wave absorbing, wide-frequency wave transmission, or wide-frequency wave absorbing for the electromagnetic wave.

Further, the three-dimensional structure metamaterial can implement conversion from vertical polarization to horizontal polarization, conversion from horizontal polarization to vertical polarization, conversion from horizontal polarization to circular polarization, or conversion from circular polarization to horizontal polarization for the electromagnetic wave.

Further, the three-dimensional structure metamaterial can implement beam divergence, beam convergence or beam deflection for the electromagnetic wave.

Further, the surface of the three-dimensional structure metamaterial is formed of at least two geometric areas expandable into planes.

Further, a ratio of a maximum Gaussian curvature to a minimum Gaussian curvature in the geometric areas expandable into planes on the surface of the three-dimensional structure metamaterial is less than 100.

Further, a ratio of a maximum Gaussian curvature to a minimum Gaussian curvature in the geometric areas expandable into planes on the surface of the three-dimensional structure metamaterial is less than 80.

Further, a ratio of a maximum Gaussian curvature to a minimum Gaussian curvature in the geometric areas expandable into planes on the surface of the three-dimensional structure metamaterial is less than 50.

Further, a ratio of a maximum Gaussian curvature to a minimum Gaussian curvature in the geometric areas expandable into planes on the surface of the three-dimensional structure metamaterial is less than 20.

Further, a ratio of a maximum Gaussian curvature to a minimum Gaussian curvature in the geometric areas expandable into planes on the surface of the three-dimensional structure metamaterial is less than 10.

Further, the flexible function layer includes multiple flexible subsubstrates, and one flexible subsubstrate corresponds to one plane generated by expanding the surface of the three-dimensional structure metamaterial.

Further, the artificial microstructures on different flexible subsubstrates have a same topology.

Further, the artificial microstructures on different flexible subsubstrates have different topologies.

Further, the three-dimensional structure metamaterial includes multiple electromagnetic areas, an electromagnetic wave that is incident into each electromagnetic area has one or more electromagnetic parameter ranges, and an artificial microstructure in each electromagnetic area generates a preset electromagnetic response to an electromagnetic wave that is incident into the electromagnetic area.

Further, differences between a maximum value and a minimum value of one or more electromagnetic parameters of an electromagnetic wave that is incident into each electromagnetic area are equal.

Further, differences between a maximum value and a minimum value of one or more electromagnetic parameters of an electromagnetic wave that is incident into each electromagnetic area are unequal.

Further, each electromagnetic area is located in one flexible subsubstrate, or each electromagnetic area is located across multiple flexible subsubstrates.

Further, the electromagnetic parameter range is an incident angle range, an axial ratio range, a phase value range, or an incident angle range of an electrical field of the electromagnetic wave.

Further, the artificial microstructures on at least one flexible function layer in each electromagnetic area have a same topological shape but different sizes.

Further, the artificial microstructures on the flexible function layer in each electromagnetic area have a same topological shape.

Further, the artificial microstructures on at least one flexible function layer in each electromagnetic area have a different topological shape than artificial microstructures on other flexible function layers.

Further, on the flexible substrate, a structure for strengthening a bonding force between the flexible substrate and formed substrate layers adjacent to the flexible substrate is disposed.

Further, the structure is a hole or slot that is provided on the flexible substrate.

Further, the artificial microstructures are structures that are formed of conductive materials and have a geometric pattern.

Further, the conductive materials are metal or nonmetal conductive materials.

Further, the metal is a gold, a silver, a copper, a gold alloy, a silver alloy, a copper alloy, a zinc alloy, or an aluminum alloy.

Further, the nonmetal conductive material is a conductive graphite, an indium tin oxide, or an aluminum-doped zinc oxide.

Further, the geometric pattern of the artificial microstructures is a diamond shape, a snowflake shape, an I-shape, a hexagonal shape, a hexagonal ring shape, a cross-slotted shape, a cross ring shape, a Y-hole shape, a Y-ring shape, a round-hole shape, or an annular shape.

Further, each layer of formed substrate is equal in thickness.

Further, each layer of formed substrate is unequal in thickness.

Further, a material of the formed substrate is a fiber-reinforced resin composite material or a fiber-reinforced ceramic matrix composite material.

Further, the fiber is a glass fiber, a quartz fiber, an aramid fiber, a polyethylene fiber, a carbon fiber or a polyester fiber.

Further, the resin in the fiber-reinforced resin composite material is thermosetting resin.

Further, the thermosetting resin includes an epoxy type, a cyanate type, a bismaleimide resin, and a modified resin system thereof or a mixed system thereof.

Further, the resin in the fiber-reinforced resin composite material is thermoplastic resin.

Further, the thermoplastic resin includes polyimide, polyether ether ketone, polyether imide, polyphenylene sulfide, or polyester.

Further, the ceramic includes aluminum oxide, silicon oxide, barium oxide, iron oxide, magnesium oxide, zinc oxide, calcium oxide, strontium oxide, titanium oxide, or a mixture thereof.

According to the first aspect of the disclosure, a radome is further provided, where the radome is the three-dimensional structure metamaterial.

According to the first aspect of the disclosure, a wave-absorbing material is further provided, which includes the three-dimensional structure metamaterial.

According to the disclosure, a filter is further provided, which includes the three-dimensional structure metamaterial.

According to the disclosure, an antenna is further provided, which includes the three-dimensional structure metamaterial.

According to the first aspect of the disclosure, a polarizer is further provided, which includes the three-dimensional structure metamaterial.

Due to a simple preparation process, a low processing cost, and simple craft precision control, the three-dimensional structure metamaterial according to the first aspect of the disclosure may replace various mechanical parts that have complicated curved surfaces and need to have a specific electromagnetic modulation function, and may also be attached onto various mechanical parts that have complicated curved surfaces to implement a desired electromagnetic modulation function. In addition, by means of curved surface expanding and electromagnetic zoning, a three-dimensional structure metamaterial has a high electromagnetic responsivity and a wide application scope.

A technical issue to be solved in a second aspect of the disclosure is to put forward a three-dimensional structure metamaterial preparation method with a simple processing process in view of disadvantages of the prior art.

A technical solution of the technical issue to be solved in a second aspect of the disclosure is to put forward a three-dimensional structure metamaterial preparation method, which includes the following steps: making a formed substrate according to a shape of a three-dimensional structure metamaterial; arranging artificial microstructures onto a flexible substrate; attaching the flexible substrate onto the formed substrate; and performing thermosetting formation.

Further, the three-dimensional structure metamaterial includes at least two layers of the flexible substrate and at least two layers of the formed substrate.

Further, the three-dimensional structure metamaterial includes at least three layers of the formed substrate and three layers of the flexible substrate, where the flexible substrate is disposed between two adjacent layers of the formed substrate.

Further, the formed substrate and the flexible substrate are spaced alternatively.

Further, each flexible substrate is disposed in a close-fitting manner, and the flexible function layer fits the surface of the formed substrate closely.

The formed substrate is produced by laying prepregs formed of multiple resin sheets and fibers.

Further, the formed substrate is produced by coating fiber cloth with resin.

Further, the surface of the three-dimensional structure metamaterial is formed of at least two geometric areas expandable into planes.

Further, a ratio of a maximum Gaussian curvature to a minimum Gaussian curvature in the geometric areas expandable into planes on the surface of the three-dimensional structure metamaterial is less than 100.

Further, a ratio of a maximum Gaussian curvature to a minimum Gaussian curvature in the geometric areas expandable into planes on the surface of the three-dimensional structure metamaterial is less than 80.

Further, a ratio of a maximum Gaussian curvature to a minimum Gaussian curvature in the geometric areas expandable into planes on the surface of the three-dimensional structure metamaterial is less than 50.

Further, a ratio of a maximum Gaussian curvature to a minimum Gaussian curvature in the geometric areas expandable into planes on the surface of the three-dimensional structure metamaterial is less than 20.

Further, a ratio of a maximum Gaussian curvature to a minimum Gaussian curvature in the geometric areas expandable into planes on the surface of the three-dimensional structure metamaterial is less than 10.

Further, the flexible substrate is attached onto the surface of the formed substrate in the following steps: expanding the three-dimensional structure metamaterial into multiple planes, cutting the flexible substrate into multiple flexible subsubstrates corresponding to the multiple planes, and attaching the flexible subsubstrates to a surface area corresponding to the formed substrate.

Further, the artificial microstructures on different flexible subsubstrates have a same topology.

Further, the artificial microstructures on different flexible subsubstrates have different topologies.

Further, a layout of the artificial microstructures on the flexible substrate is determined in the following steps: calculating one or more electromagnetic parameter values at different places of the three-dimensional structure metamaterial; dividing the three-dimensional structure metamaterial into multiple electromagnetic areas according to one or more of the electromagnetic parameter values, where each electromagnetic area corresponds to a parameter value range of one or more electromagnetic parameters; and designing the artificial microstructures in each electromagnetic area so that a part of the three-dimensional structure metamaterial, which corresponds to the electromagnetic area, can generate a preset electromagnetic response to an electromagnetic wave that is incident into the electromagnetic area.

Further, differences between a maximum value and a minimum value of electromagnetic wave parameter value ranges corresponding to each electromagnetic area are equal.

Further, differences between a maximum value and a minimum value of electromagnetic wave parameter value ranges corresponding to each electromagnetic area are unequal.

Further, each electromagnetic area is located in one flexible subsubstrate, or each electromagnetic area is located across multiple flexible subsubstrates.

Further, the electromagnetic parameters are an incident angle of an electromagnetic wave, an axial ratio, a phase value, or an electrical field incident angle of the electromagnetic wave.

Further, the artificial microstructures on at least one flexible function layer in each electromagnetic area have a same topological shape but different sizes.

Further, the artificial microstructures on the flexible function layer in each electromagnetic area have a same topological shape.

Further, the artificial microstructures on at least one flexible function layer in each electromagnetic area have a different topological shape than artificial microstructures on other flexible function layers.

Further, a step of opening a hole or slot on the flexible substrate is further included.

Further, the artificial microstructures are structures that are formed of conductive materials and have a geometric pattern.

Further, the artificial microstructures are arranged on the flexible substrate by etching, diamond etching, electroetching, or ion etching.

Further, the conductive materials are metal or nonmetal conductive materials.

Further, the metal is a gold, a silver, a copper, a gold alloy, a silver alloy, a copper alloy, a zinc alloy, or an aluminum alloy.

Further, the nonmetal conductive material is a conductive graphite, an indium tin oxide, or an aluminum-doped zinc oxide.

Further, the geometric pattern of the artificial microstructures is a diamond shape, a snowflake shape, an I-shape, a hexagonal shape, a hexagonal ring shape, a cross-slotted shape, a cross ring shape, a Y-hole shape, a Y-ring shape, a round-hole shape, or an annular shape.

Further, a material of the flexible substrate is a polyimide, polyester, polytetrafluoroethylene, polyurethane, polyarylate, PET film, PE film or PVC film.

Further, the fiber is a glass fiber, a quartz fiber, an aramid fiber, a polyethylene fiber, a carbon fiber or a polyester fiber.

Further, the resin is thermosetting resin.

Further, the thermosetting resin includes an epoxy type, a cyanate type, a bismaleimide resin, and a modified resin system thereof or a mixed system thereof.

Further, the resin is thermoplastic resin.

Further, the thermoplastic resin includes polyimide, polyether ether ketone, polyether imide, polyphenylene sulfide, or polyester.

According to the second aspect of the disclosure, a three-dimensional structure metamaterial is made by using a flexible substrate and a formed substrate, which avoids a step of three-dimensional engraving or etching, reduces process complexity, and leads to a low processing cost and simple craft precision control. The three-dimensional structure metamaterial, which is made by using the preparation method according to the second aspect of the disclosure, may replace various mechanical parts that have complicated curved surfaces and need to have a specific electromagnetic modulation function, and may also be attached onto various mechanical parts that have complicated curved surfaces to implement a desired electromagnetic modulation function. In addition, by means of curved surface expanding and electromagnetic zoning, a three-dimensional structure metamaterial has a high electromagnetic responsivity and a wide application scope.

A technical issue to be solved in a third aspect of the disclosure is to put forward, in view of disadvantages of the prior art, a metamaterial that can expand an application scope of the metamaterial.

A technical solution of a technical issue to be solved according to a third aspect of the disclosure is to put forward a metamaterial, which includes: at least one layer of substrate and multiple artificial microstructures disposed on a surface of each layer of substrate; the metamaterial includes multiple electromagnetic areas, an electromagnetic wave that is incident into each electromagnetic area has one or more electromagnetic parameter ranges, and an artificial microstructure in each electromagnetic area generates a preset electromagnetic response to an electromagnetic wave that is incident into the electromagnetic area.

Further, differences between a maximum value and a minimum value of one or more electromagnetic parameters of an electromagnetic wave that is incident into each electromagnetic area are equal.

Further, differences between a maximum value and a minimum value of one or more electromagnetic parameters of an electromagnetic wave that is incident into each electromagnetic area are unequal.

Further, the electromagnetic parameter range is an incident angle range, an axial ratio range, a phase value range, or an incident angle range of an electrical field of the electromagnetic wave.

Further, the artificial microstructures in each electromagnetic area have a same topological shape but different sizes.

Further, the artificial microstructures in different electromagnetic areas have different topological shapes.

Further, the metamaterial includes two or at least three layers of substrates.

Further, each layer of substrate is different in thickness.

Further, each layer of substrate is the same in thickness.

Further, each layer of substrate is disposed in a close-fitting manner or each layer of substrate is spaced alternatively.

Further, the metamaterial can implement electromagnetic wave modulation functions such as wave transmission, wave absorbing, beam forming, polarization conversion or directivity pattern modulation for the electromagnetic wave.

Further, the metamaterial can implement frequency-selective wave transmission, frequency-selective wave absorbing, wide-frequency wave transmission, or wide-frequency wave absorbing for the electromagnetic wave.

Further, the metamaterial can implement conversion from vertical polarization to horizontal polarization, conversion from horizontal polarization to vertical polarization, conversion from horizontal polarization to circular polarization, or conversion from circular polarization to horizontal polarization for the electromagnetic wave.

Further, the metamaterial can implement beam divergence, beam convergence or beam deflection for the electromagnetic wave.

Further, the surface of the substrate is a plane.

Further, the surface of the substrate is formed of at least two geometric areas expandable into planes.

Further, a ratio of a maximum Gaussian curvature to a minimum Gaussian curvature in the geometric areas expandable into planes on the surface of the substrate is less than 100.

Further, a ratio of a maximum Gaussian curvature to a minimum Gaussian curvature in the geometric areas expandable into planes on the surface of the substrate is less than 80.

Further, a ratio of a maximum Gaussian curvature to a minimum Gaussian curvature in the geometric areas expandable into planes on the surface of the substrate is less than 50.

Further, a ratio of a maximum Gaussian curvature to a minimum Gaussian curvature in the geometric areas expandable into planes on the surface of the substrate is less than 20.

Further, a ratio of a maximum Gaussian curvature to a minimum Gaussian curvature in the geometric areas expandable into planes on the surface of the substrate is less than 10.

Further, the artificial microstructures in each electromagnetic area have topological shapes and sizes that are not completely the same.

Further, the metamaterial further includes multiple flexible substrates, each flexible substrate corresponds to one geometric area expandable into a plane on the surface of the substrate, the artificial microstructures are attached onto the flexible substrate, and the flexible substrate is attached onto the surface of the substrate or disposed between multiple substrates.

Further, a material of the substrate is a ceramic material, a ferroelectric material, a ferrite material, or a macromolecular polymer material.

Further, a material of the substrate is a prepreg formed of resin and reinforcing fibers.

Further, the reinforcing fiber is a glass fiber, a quartz fiber, an aramid fiber, a polyethylene fiber, a carbon fiber or a polyester fiber.

Further, the resin is thermosetting resin.

Further, the thermosetting resin includes an epoxy type, a cyanate type, a bismaleimide resin, and a modified resin system thereof or a mixed system thereof.

Further, the resin is thermoplastic resin.

Further, the thermoplastic resin includes polyimide, polyether ether ketone, polyether imide, polyphenylene sulfide, or polyester.

Further, the artificial microstructures are structures that are formed of conductive materials and have a geometric pattern.

Further, the conductive materials are metal or nonmetal conductive materials.

Further, the metal is a gold, a silver, a copper, a gold alloy, a silver alloy, a copper alloy, a zinc alloy, or an aluminum alloy.

Further, the nonmetal conductive material is a conductive graphite, an indium tin oxide, or an aluminum-doped zinc oxide.

Further, the geometric pattern of the artificial microstructures is a diamond shape, a snowflake shape, an I-shape, a hexagonal shape, a hexagonal ring shape, a cross-slotted shape, a cross ring shape, a Y-hole shape, a Y-ring shape, a round-hole shape, or an annular shape.

According to a third aspect of the disclosure, a metamaterial design method is further provided, which includes the following steps:

calculating one or more electromagnetic parameter values at each place of a metamaterial;

dividing the metamaterial into multiple electromagnetic areas, where each electromagnetic area corresponds to one or more electromagnetic parameter ranges; and designing artificial microstructures for one or more electromagnetic parameter ranges of each electromagnetic area so that each electromagnetic area can generate a preset electromagnetic response.

Further, differences between a maximum value and a minimum value of one or more electromagnetic parameter ranges corresponding to each electromagnetic area are equal.

Further, differences between a maximum value and a minimum value of one or more electromagnetic parameter ranges corresponding to each electromagnetic area are equal.

Further, the electromagnetic parameter range is an incident angle range, an axial ratio range, a phase value range, or an incident angle range of an electrical field of the electromagnetic wave.

Further, the artificial microstructures in each electromagnetic area have a same topological shape but different sizes.

Further, the artificial microstructures in different electromagnetic areas have different topological shapes.

According to the third aspect of the disclosure, a radome is further provided, where the radome is the metamaterial.

According to the third aspect of the disclosure, a wave-absorbing material is further provided, which includes the metamaterial.

According to the third aspect of the disclosure, a filter is further provided, which includes the metamaterial.

According to the third aspect of the disclosure, an antenna is further provided, which includes the metamaterial.

According to the third aspect of the disclosure, a polarization conversion is further provided, which includes the metamaterial.

According to the third aspect of the disclosure, a metamaterial is divided into multiple electromagnetic areas, artificial microstructures in each electromagnetic area only need to respond to electromagnetic waves in a corresponding electromagnetic parameter range, thereby simplifying metamaterial design and expanding an application scope of the metamaterial. Further, according to the third aspect of the disclosure, the artificial microstructures in each electromagnetic area are attached onto a surface of a substrate of a curved surface by expanding the curved surface. Therefore, the metamaterial according to the third aspect of the disclosure is not limited to the existing planar form, and may replace various mechanical parts that have complicated curved surfaces and need to have a specific electromagnetic modulation function, and may also be attached onto various mechanical parts that have complicated curved surfaces to implement a desired electromagnetic modulation function.

DESCRIPTION OF EMBODIMENTS

Embodiment 1

Figure 1:
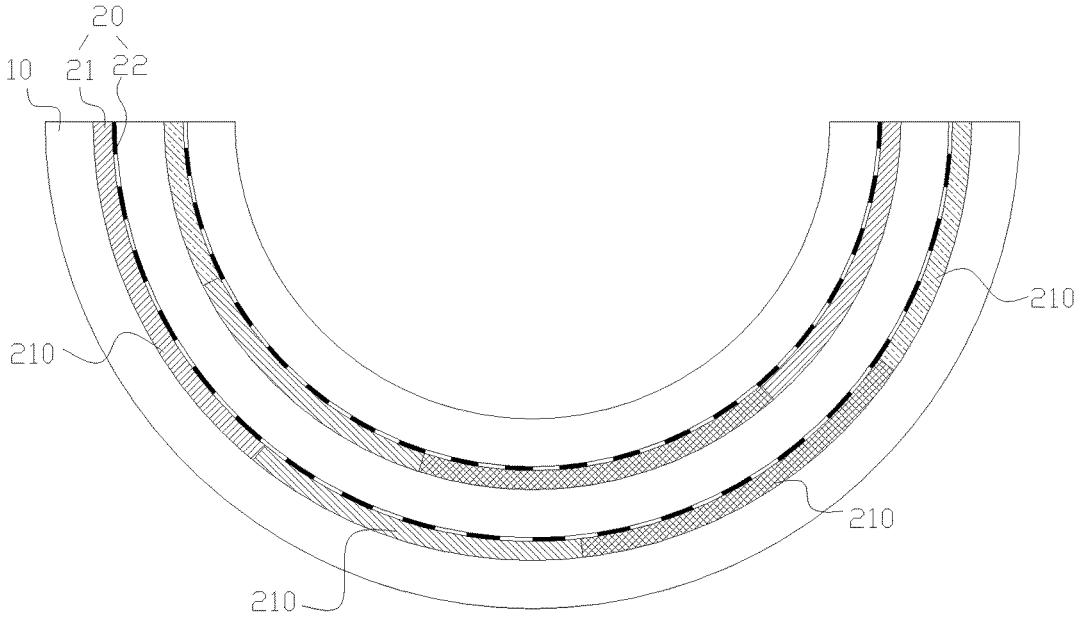
FIG. 1 is a partial sectional view of a three-dimensional structure metamaterial in a preferred implementation manner according to Embodiment 1 of the disclosure.

Referring to FIG. 1, FIG. 1 is a partial sectional view of a three-dimensional structure metamaterial in a preferred implementation manner according to Embodiment 1 of the disclosure. In FIG. 1, a three-dimensional structure metamaterial includes multiple layers of formed substrates 10, flexible function layers 20 that fit surfaces of the formed substrates 10 closely, where each flexible function layer includes a flexible substrate 21 formed of at least one flexible subsubstrate 210 and multiple artificial microstructures 22 that are disposed on each flexible subsubstrate 210 and capable of responding to an electromagnetic wave, and the three-dimensional structure metamaterial has an electromagnetic wave modulation function.

In an implementation manner of Embodiment 1 of the disclosure, the three-dimensional structure metamaterial may include at least two flexible function layers and at least two layers of the formed substrate. In a preferred implementation manner, FIG. 1 includes three layers of formed substrates 10 and two flexible function layers 20. The multiple layers of formed substrates 10 leads to higher mechanical performance of the three-dimensional structure metamaterial. In addition, the multiple flexible function layers 20 lead to electromagnetic coupling between adjacent flexible function layers 20. By optimizing a distance between the adjacent flexible function layers 20, the responsivity of the entire three-dimensional structure metamaterial to an electromagnetic wave is optimized. The distance between the adjacent flexible function layers 20 is a thickness of the formed substrate 10. Therefore, the thickness of each formed substrate 10 is adjustable as required. That is, the formed substrates 10 may be the same or different in thickness.

Figure 9:
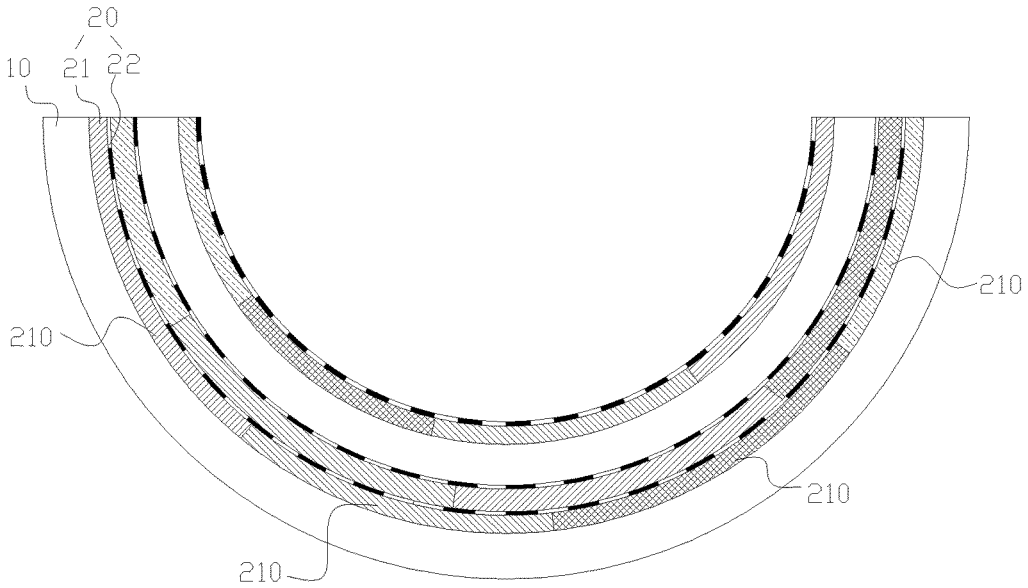
FIG. 9 is a partial sectional view of a three-dimensional structure metamaterial in another preferred implementation manner according to Embodiment 1 of the disclosure.

As shown in FIG. 1, when the three-dimensional structure metamaterial includes multiple flexible function layers 20, the flexible function layers 20 and the formed substrates 10 are spaced alternatively. In another implementation manner of Embodiment 1 of the disclosure, as shown in FIG. 9, when multiple flexible function layers 20 are included between the two layers of formed substrates 10 of the three-dimensional structure metamaterial, each flexible function layer 20 is disposed in a close-fitting manner, and the close-fitted flexible function layers are disposed on the surfaces of the formed substrates 10.

The three-dimensional structure metamaterial may be prepared in the following manner: preparing a uncured formed substrate 10, attaching the flexible substrate onto the uncured formed substrate 10, and then curing them together into a shape. The material of the formed substrate 10 may be multiple layers of fiber-reinforced resin composite materials or fiber-reinforced ceramic matrix composite materials. The uncured formed substrate 10 may be multiple layers of quartz fiber-reinforced epoxy prepreg that are laid on a mold, or may be a result of repeating a process in which carbon fiber-reinforced plastic is coated with polyester resin evenly after a mold is coated with the carbon fiber-reinforced plastic.

The reinforcing fiber is not limited to the enumerated quartz fiber and carbon fiber, and may also be a glass fiber, an aramid fiber, a polyethylene fiber, a polyester fiber, or the like. The resin is not limited to the enumerated epoxy and polyester resin, and may also be other thermosetting resin or thermoplastic resin, for example, may be cyanate resin, bismaleimide resin, and modified resin thereof or a mixed system thereof, and may also be polyimide, polyether ether copper, polyether ether imide, polyphenylene sulfide, or polyester, or the like. The ceramic includes constituents such as aluminum oxide, silicon oxide, barium oxide, iron oxide, magnesium oxide, zinc oxide, calcium oxide, strontium oxide, titanium oxide, or a mixture thereof.

The flexible substrate may be a thermoplastic material or a thermoplastic composite material with flexible fibers, and preferably, the material of the flexible substrate may be a polyimide, polyester, polytetrafluoroethylene, polyurethane, polyarylate, PET (Polyethylene terephthalate) film, PE (Polyethylene) film or PVC (polyvinyl chloride) film or the like. The flexible fiber may be a polyester fiber, a polyethylene fiber, or the like.

Preferably, on the flexible substrate 21 of the flexible function layer 20, a structure for strengthening a bonding force between the flexible substrate and the formed substrate layers 10 adjacent to the flexible substrate is disposed. The structure may be a hook-shaped structure or a clasp-shaped structure or the like, and is preferably one or more slots or holes provided on the flexible substrate 21. At the time of making a three-dimensional structure metamaterial after slots or holes are opened on the flexible substrate 21, some materials of the adjacent formed substrates 10 are stuffed in the slot or hole. When the formed substrate 10 is cured, the materials between the slots or holes are also cured, which leads to close connections between the adjacent formed substrates 10. In this way, the structure is simple, and no other structure or step is required additionally. When the formed substrate 10 is shaped, the structure for strengthening the bonding force between layers may be generated at the same time.

When the surface of the three-dimensional structure metamaterial is relatively complicated, if only one flexible subsubstrate 210 is applied and attached onto the formed substrate 10, the flexible substrate 210 may form wrinkles in some areas. As a consequence of the wrinkles, the flexible subsubstrate 210 is not close-fitting enough, and responsivity of the artificial microstructures disposed on the flexible subsubstrate 210 to an electromagnetic wave is affected.

Figure 2:
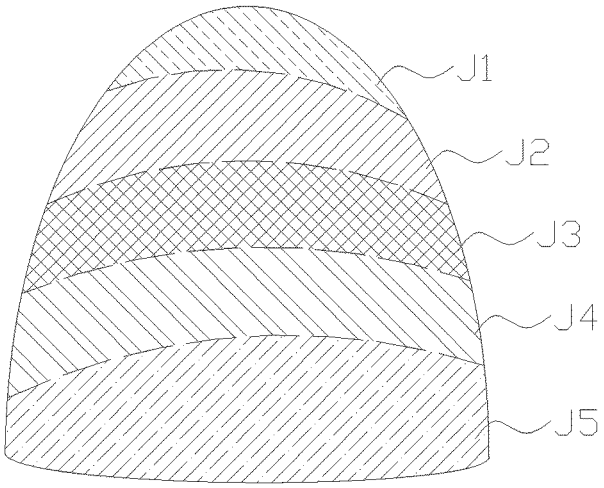
FIG. 2 is a stereoscopic structural diagram of a three-dimensional structure metamaterial in a preferred implementation manner according to Embodiment 1 of the disclosure.

FIG. 2 is a stereoscopic structural diagram of a three-dimensional structure metamaterial in a preferred implementation manner. The Gaussian curvature differs sharply between difference places on the surface of the three-dimensional structure metamaterial, and the metamaterial is not expandable into a plane. That is, in preparing the three-dimensional structure metamaterial, the winkle phenomenon may occur if only one flexible subsubstrate is applied.

To solve the foregoing problem, in designing of this embodiment, the surface of the three-dimensional structure metamaterial is divided into multiple geometric areas. Each geometric area is expandable into a plane, and each plane may correspond to a flexible subsubstrate 210. During the preparing, the flexible subsubstrate 210 corresponding to each plane is attached onto a surface area of the formed substrate correspondingly. When the three-dimensional structure metamaterial is cured into a shape, each flexible subsubstrate 210 can fit the surface of the formed substrate closely without generating wrinkles. In addition, the electromagnetic response of the flexible substrate formed of all flexible subsubstrates 210 can meet requirements. In an implementation manner, the surface of the three-dimensional structure metamaterial is formed of at least two geometric areas expandable into planes.

In this embodiment, the surface of the three-dimensional structure metamaterial is divided into multiple geometric areas in the following manner: analyzing the Gaussian curvature distribution on the surface of the three-dimensional structure metamaterial, and dividing a part with a similar Gaussian curvature distribution to form a geometric area. If the surface is divided into more geometric areas, the probability of generating wrinkles when each flexible subsubstrate 210 in a corresponding geometric area is attached onto the surface of the formed substrate is lower, the required craft precision is higher, but processing and formation are more difficult. To achieve a trade-off between the two, the surface of the three-dimensional structure metamaterial is generally divided into 5-15 geometric areas according to the Gaussian curvature. A ratio of a maximum Gaussian curvature to a minimum Gaussian curvature of the entire three-dimensional structure metamaterial is used as a reference. In division into the geometric areas, the ratio of the maximum Gaussian curvature to the minimum Gaussian curvature in each geometric area is generally less than 100, but may also be less than 80, less than 50 or less than 30, or the like. Preferably, the ratio of the maximum Gaussian curvature to the minimum Gaussian curvature in each geometric area is less than 20. Further preferably, the ratio of the maximum Gaussian curvature to the minimum Gaussian curvature in each geometric area is less than 10.

Figure 3:
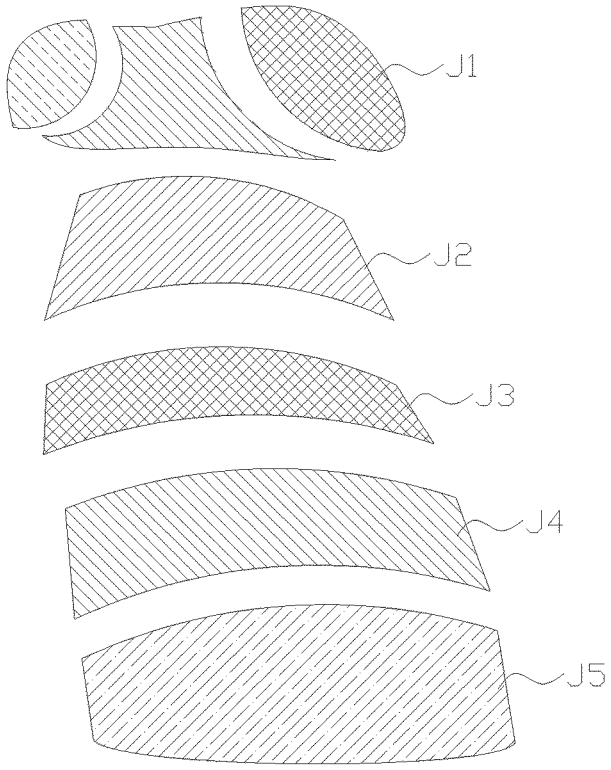
FIG. 3 is a planar schematic diagram of a three-dimensional structure metamaterial shown in FIG. 2 and expanded according to a Gaussian curvature.

Keep referring to FIG. 2 and FIG. 3, FIG. 2 shows a three-dimensional structure metamaterial divided into multiple geometric areas according to the Gaussian curvature. In FIG. 2, the three-dimensional structure metamaterial is divided into 5 geometric areas J1-J5 according to the Gaussian curvature. FIG. 3 is a planar schematic diagram of planes generated by expanding multiple geometric areas shown in FIG. 2. FIG. 3 shows 5 planes P1-P5 that are generated by expanding the 5 geometric areas in FIG. 2 correspondingly. Preferably, in FIG. 3, to facilitate making, a relatively long geometric area is cut into multiple sub-planes.

A flexible subsubstrate is made according to the planes generated by expansion, and artificial microstructures are arranged on the flexible subsubstrate. Subsequently, multiple flexible subsubstrates, on which the artificial microstructures are arranged, are attached onto a corresponding surface of the formed substrate according to the geometric areas generated above, so as to form a three-dimensional structure metamaterial. In this embodiment, the artificial microstructures are generated on the flexible subsubstrate. Therefore, a conventional panel metamaterial preparation method may be applied instead of such methods as three-dimensional etching and engraving, which saves costs. In addition, division into areas in this embodiment ensures that, when multiple flexible subsubstrates are spliced into a flexible substrate, the multiple flexible subsubstrates do not generate wrinkles. That is, the artificial microstructures will not be distorted, which ensures craft precision of the three-dimensional structure metamaterial.

The artificial microstructures on the multiple flexible subsubstrates may have the same topological shape and sizes. However, because the surface of the three-dimensional structure metamaterial is irregular, parameter values of electromagnetic waves that are incident into different places on the surface of the three-dimensional structure metamaterial are different. The electromagnetic waves that are incident into different places on the surface of the three-dimensional structure metamaterial may be represented by different electromagnetic parameters. Which electromagnetic parameters are selected for representing the electromagnetic waves depends on the function of the three-dimensional structure metamaterial. For example, if the three-dimensional structure metamaterial needs to implement the same electromagnetic response to the electromagnetic waves with different incident angles, the electromagnetic waves that are incident into different places on the surface of the three-dimensional structure metamaterial may be represented by the incident angles. For another example, if the three-dimensional structure metamaterial needs to implement conversion of an electromagnetic wave into a plane wave or implement beam forming functions such as electromagnetic wave convergence and divergence, the electromagnetic waves that are incident into different places on the surface of the three-dimensional structure metamaterial may be represented by a phase value. For another example, if the three-dimensional structure metamaterial needs to implement conversion of a polarization mode of an electromagnetic wave, the electromagnetic waves that are incident into different places on the surface of the three-dimensional structure metamaterial may be represented by an axial ratio or an electrical field incident angle. Conceivably, when the three-dimensional structure metamaterial needs to implement multiple functions simultaneously, multiple electromagnetic parameters may be used to represent the electromagnetic waves that are incident into the surface of the three-dimensional structure metamaterial.

If the same artificial microstructure topology is applied on the flexible substrate so that the artificial microstructure topology makes an expected response to different parameter values of a specific electromagnetic parameter, the design of the artificial microstructures is too difficult or even impracticable. In addition, in practical application, to accomplish a specific function, the three-dimensional structure metamaterial generally needs to satisfy multiple electromagnetic parameters simultaneously. In this case, it is more difficult to design artificial microstructures of the same topology which can both satisfy the electromagnetic response to different parameter values of a specific electromagnetic parameter and satisfy the electromagnetic response to different electromagnetic parameters.

To solve the foregoing problem, in Embodiment 1 of the disclosure, the three-dimensional structure metamaterial is divided into multiple electromagnetic areas according to different electromagnetic parameter values of electromagnetic waves that are incident into different areas of the three-dimensional structure metamaterial. Each electromagnetic area may correspond to a parameter value range of an electromagnetic parameter. The topology of the artificial microstructure in this electromagnetic area is designed with reference to the parameter value range, which both simplifies design and enables different areas of the three-dimensional structure metamaterial to have a preset electromagnetic response capability.

The following describes a design manner of electromagnetic areas of a three-dimensional structure metamaterial by assuming that the three-dimensional structure metamaterial needs to have the same electromagnetic response to electromagnetic waves at different incident angles.

Figure 4:
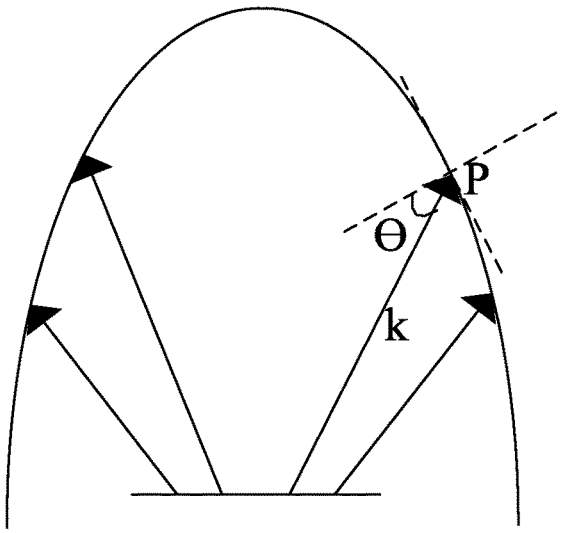
FIG. 4 is a schematic diagram of an incident angle of an electromagnetic wave that is incident into a point P on a surface of a three-dimensional structure metamaterial according to Embodiment 1 of the disclosure.
Figure 5:
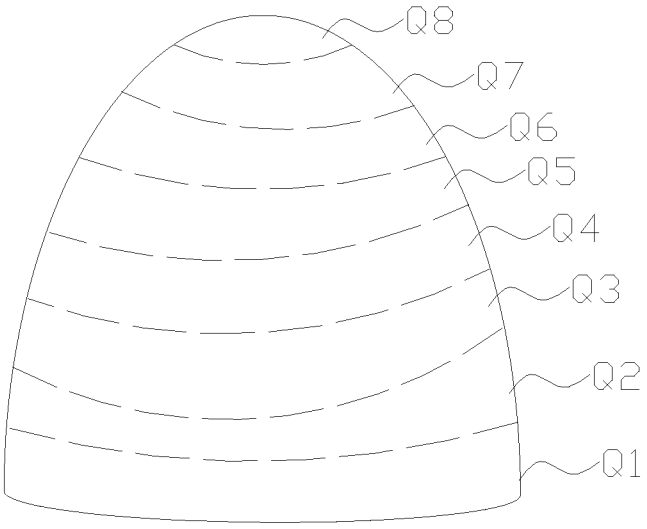
FIG. 5 is a schematic structural diagram of dividing a surface of a three-dimensional structure metamaterial into multiple electromagnetic areas according to an incident angle range according to Embodiment 1 of the disclosure.

An incident angle when an electromagnetic wave is incident into a specific point P on a surface of a three-dimensional structure metamaterial may be defined in the manner shown in FIG. 4. That is, according to information about a wavevector K of the electromagnetic wave and a normal line of a tangent plane corresponding to the point P, an incident angle θ of the electromagnetic wave at the point P is calculated. The information about the wavevector K is not limited to a specific angle value, it may also be an angle value range. Incident angle values at all points on the surface of the three-dimensional structure metamaterial are obtained in the way described above, and the surface of the three-dimensional structure metamaterial is divided into multiple electromagnetic areas according to the incident angle values at different points. FIG. 5 shows a division manner of electromagnetic areas in a specific embodiment. In FIG. 5, the surface of the three-dimensional structure metamaterial is divided into eight electromagnetic areas Q1-Q8 at intervals of 11° of the incident angle. That is, the electromagnetic area Q1 corresponds to electromagnetic waves whose incident angles are 0°-11°, the electromagnetic area Q2 corresponds to electromagnetic waves whose incident angles are 12°-23°, and the electromagnetic area Q4 corresponds to electromagnetic waves whose incident angles are 24°-35°, and so on. In this embodiment, the difference between a maximum value and a minimum value of the incident angle is the same between the electromagnetic areas, so as to simplify design. However, on some occasions, for example, when it is known that a topology of an artificial microstructure is well electromagnetically responsive to electromagnetic waves whose incident angles are 0°-30°, the surface may be divided into electromagnetic areas onto which the incident angles are 0°-30°, 31°-40°, 41°-50°, and so on. The specific division manner may be set according to specific requirements, and is not limited in the disclosure.

The shape of the artificial microstructures in each electromagnetic area is designed according to information about the incident angle range of each electromagnetic area so that requirements are satisfied, for example, requirements of absorbing electromagnetic waves, being penetrated by electromagnetic waves, and the like. Because the span of the incident angle range in each electromagnetic area is small, it is simple to design artificial microstructures in allusion to the electromagnetic area. In a preferred embodiment, the artificial microstructures in each electromagnetic area have the same topology but different sizes. With a gradient of the sizes of the artificial microstructures of the same topology, the artificial microstructures can satisfy electromagnetic response requirements of an electromagnetic area. This design manner simplifies the process and reduces design costs. Understandably, the topologies and the sizes of the artificial microstructures in each electromagnetic area may also be different so long as the electromagnetic response required by the incident angle range corresponding to the electromagnetic area is satisfied.

When the three-dimensional structure metamaterial includes multiple flexible function layers, the electromagnetic area is stereo. That is, a boundary of each electromagnetic area shown in FIG. 5 is an electromagnetical zoning boundary of the three-dimensional structure metamaterial. To simplify design in a preferred embodiment, boundaries of electromagnetic zones on multiple flexible function layers inside the three-dimensional structure metamaterial coincide. The boundary of an electromagnetic area on a flexible function layer (that is, the boundary of an electromagnetic zone generated by mapping an electromagnetic area onto the flexible function layer) may be located in a flexible subsubstrate, or across multiple flexible subsubstrates. That is, geometric areas and electromagnetic areas are two different types of zoning manners, and no necessary correlation exists between them.

Generally, according to requirements and design complexity, the artificial microstructures on at least one flexible function layer in each electromagnetic area have the same topological shape but different sizes; or the artificial microstructures on the flexible function layer in each electromagnetic area have the same topological shape; or the artificial microstructures on at least one flexible function layer in each electromagnetic area have a different topological shape than the artificial microstructures of other flexible function layers.

Figure 6:
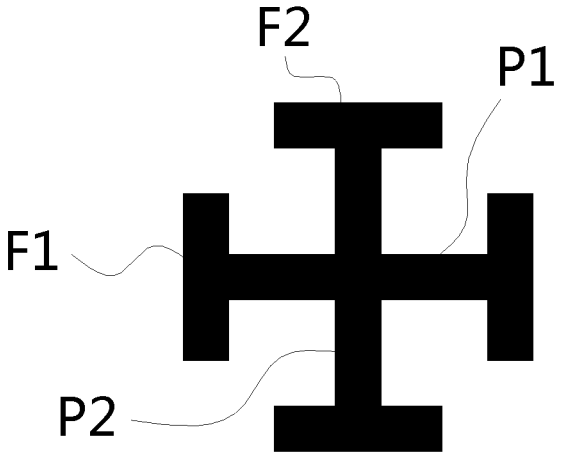
FIG. 6 is a schematic diagram of a crossed snowflake-shaped artificial microstructure according to Embodiment 1 of the disclosure.

The artificial microstructures may be structures that are formed of a conductive material and have a geometric pattern. The topological shape of the artificial microstructures may be obtained by means of computer emulation. It is appropriate to design different artificial microstructure topologies for different electromagnetic response requirements. The geometric pattern may be a crossed snowflake shape shown in FIG. 6. The crossed snowflake microstructure includes a first metal wire P1 and a second metal wire P2 that bisect each other perpendicularly. Both ends of the first metal wire P1 are connected to two first metal legs F1 of the same length, and both ends of the first metal wire P1 are connected at a midpoint of the two first metal legs F1; both ends of the second metal wire P2 are connected to two second metal legs F2 of the same length, and both ends of the second metal wire P2 are connected at a midpoint of the two second metal legs F2. The first metal leg F1 is equal to the second metal leg F2 in length.

Figure 7:
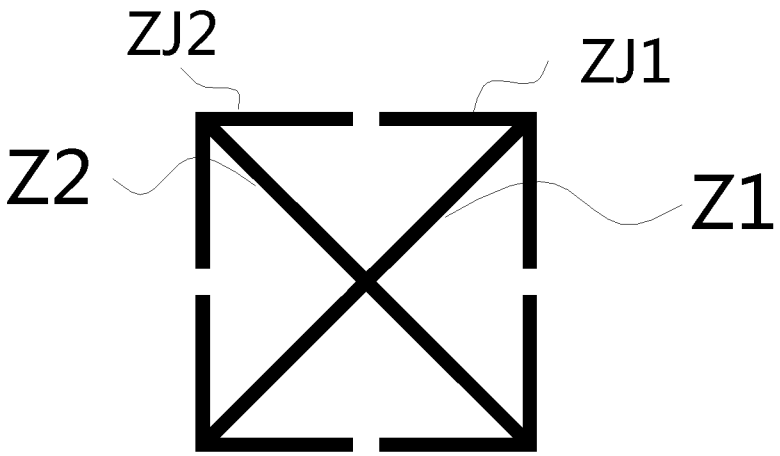
FIG. 7 is a schematic diagram of another geometric figure of an artificial microstructure.

The geometric pattern may also be a geometric figure shown in FIG. 7. In FIG. 7, the geometric pattern has a first main line Z1 and a second main line Z2 that bisect each other perpendicularly. The first main line Z1 and the second main line Z2 have a same shape and size. Both ends of the first main line Z1 are connected to two same first right-angled angular lines ZJ1, and both ends of the first main line Z1 are connected at a bend of the two first right-angled angular lines ZJ1. Both ends of the second main line Z2 are connected to two second right-angled angular lines ZJ2, and both ends of the second main line Z2 are connected at a bend of the two second right-angled angular lines ZJ2. The first right-angled angular line ZJ1 and the second right-angled angular line ZJ2 have a same shape and size. Two arms of the first right-angled angular line ZJ1 and the second right-angled angular line ZJ2 are parallel to a horizontal line. The first main Z1 and the second main line Z2 are angular bisectors of the first right-angled angular line ZJ1 and the second right-angled angular line ZJ2 respectively. The geometric pattern may also be other shapes such as a splayed annular shape, a cross shape, an I-shape, a diamond shape, a hexagonal shape, a hexagonal ring shape, a cross-hole shape, a cross ring shape, a Y-hole shape, a Y-ring shape, a round-hole shape, or an annular shape.

The material of the artificial microstructures may be a metal conductive material or a nonmetal conductive material. The metal conductive material may be gold, silver, copper, aluminum, zinc, or the like, or may be various gold alloys, aluminum alloys, zinc alloys, and the like. The nonmetal conductive material may be a conductive graphite, an indium tin oxide, or an aluminum-doped zinc oxide, or the like. The artificial microstructures may be attached onto the flexible subsubstrate by etching, diamond-etching, engraving, or the like.

When the three-dimensional structure metamaterial needs to implement a beam forming function, a phase value is used to represent the electromagnetic waves that are incident into the surface of the three-dimensional structure metamaterial. Because the surface of the three-dimensional structure metamaterial has a complicated shape, the phase values at difference places on the surface of the three-dimensional structure metamaterial are not completely the same. A proper phase value range is selected to divide the three-dimensional structure metamaterial into multiple electromagnetic areas. The ultimately required phase at each place of the three-dimensional structure metamaterial is calculated according to the function that needs to be ultimately implemented by the beam forming, such as electromagnetic wave convergence, electromagnetic wave divergence, electromagnetic wave deflection, conversion from a spherical wave into a plane wave. The artificial microstructures are arranged in each electromagnetic area so that the electromagnetic area can satisfy the phase difference corresponding to the electromagnetic area.

When the three-dimensional structure metamaterial needs to implement polarization conversion, an axial ratio or an electrical field incident angle of electromagnetic waves is used to represent the electromagnetic waves that are incident into the surface of the three-dimensional structure metamaterial. A person skilled in the art understands that a polarization mode of an electromagnetic wave is an electrical field direction of the electromagnetic wave, and a polarization effect is represented by an axial ratio. A manner of determining an electrical field incident angle of the electromagnetic wave is similar to the manner of determining an incident angle of the electromagnetic wave in FIG. 4, and is determined by only changing the direction of the wavevector K in FIG. 4 into the direction of the electrical field E. The surface of the three-dimensional structure metamaterial is divided into multiple electromagnetic areas according to information about the electrical field incident angle of the electromagnetic wave. The ultimately required electrical field direction at each place of the three-dimensional structure metamaterial is determined according to the function that needs to be ultimately implemented by the polarization conversion, such as conversion into vertical polarization, conversion into horizontal polarization, conversion into circular polarization, and the like. The artificial microstructures are arranged in each electromagnetic area so that the electromagnetic area can satisfy the angle difference of the electrical field direction corresponding to the electromagnetic area.

If the three-dimensional structure metamaterial needs to satisfy two or more electromagnetic parameters, for example, needs a large angle of responding to electromagnetic waves by the three-dimensional structure metamaterial and needs to satisfy beam forming, then the surface of the three-dimensional structure metamaterial may be divided into multiple electromagnetic fields that can satisfy the two electromagnetic parameters.

Figure 8:
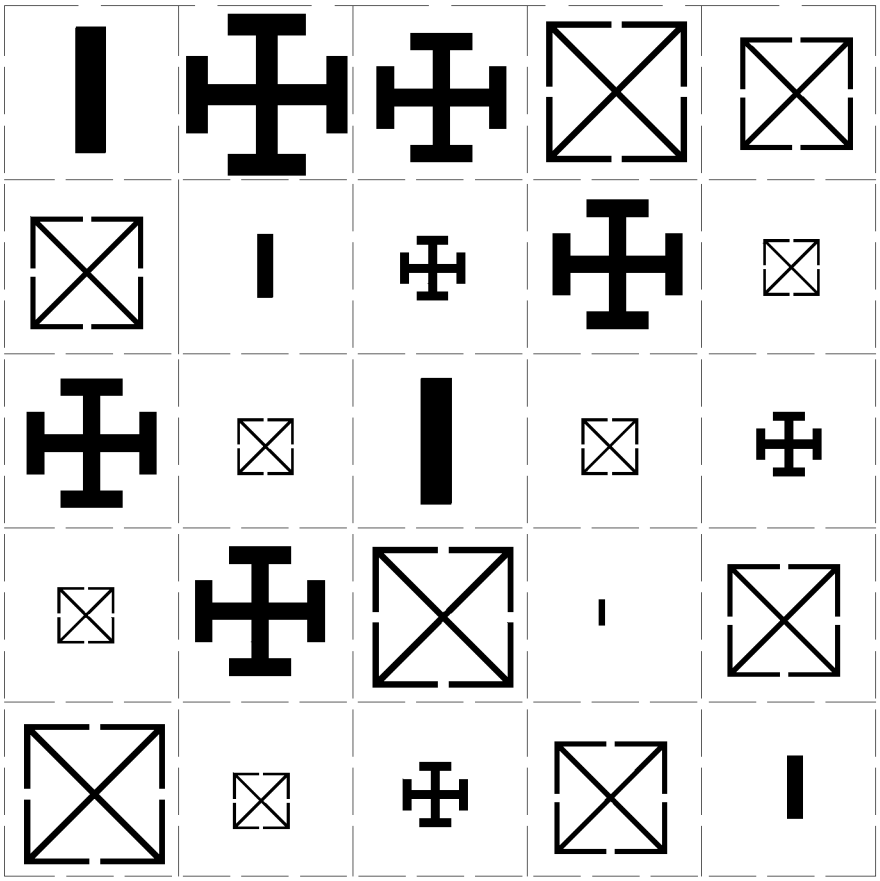
FIG. 8 is a schematic layout diagram of artificial microstructures in some areas on a flexible subsubstrate.

From comparison between FIG. 5 and FIG. 2, it can be learned that for the three-dimensional structure metamaterial of the same shape, different geometric areas and electromagnetic areas may exist. Therefore, multiple different types of artificial microstructures may exist on a flexible subsubstrate corresponding to each geometric area. For example, FIG. 8 is a schematic layout diagram of artificial microstructures in some areas on a flexible subsubstrate. However, if the geometric area of a three-dimensional structure metamaterial coincides with an electromagnetic area, the artificial microstructures on the flexible subsubstrates corresponding to each geometric area may be the same. In this way, the complexity of designing and processing is much lower.

For some three-dimensional structure metamaterials whose surfaces are not complicated, different microstructures may be attached onto one flexible substrate by using only an electromagnetic zoning manner, so that the three-dimensional structure metamaterial has preferable electromagnetic responsivity.

When the three-dimensional structure metamaterial is applied to products in a specific field, the three-dimensional structure metamaterial may be disposed according to the shape of the specific product so that the three-dimensional structure metamaterial becomes a fitting of the product. In addition, the three-dimensional structure metamaterial has a formed substrate, if the material selected for the formed substrate can satisfy application requirements of the product, the three-dimensional structure metamaterial itself may constitute a major part of the product. For example, when the three-dimensional structure metamaterial is used for making a radome, the three-dimensional structure metamaterial may be used as a body of the radome directly, or the three-dimensional structure metamaterial is disposed on the surface of the radome body made of a conventional ordinary material to enhance electromagnetic performance of the original radome body.

According to different functions of the three-dimensional structure metamaterial, the three-dimensional structure metamaterial may be prepared into an antenna, a filter, a polarizer, and the like, so as to satisfy different application requirements.

Embodiment 2

Figure 10:
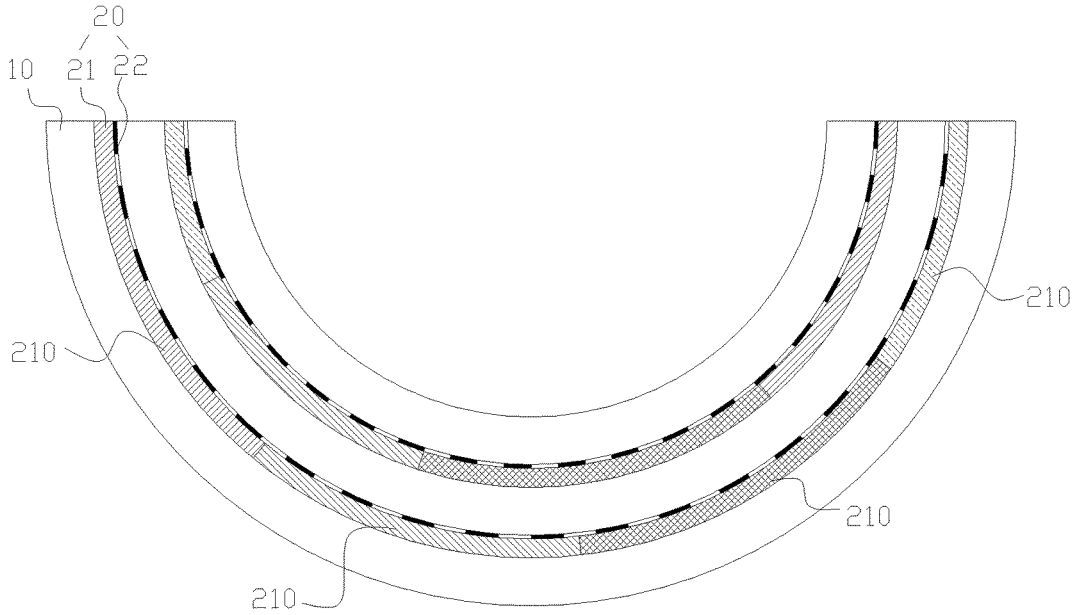
FIG. 10 is a partial sectional view of a three-dimensional structure metamaterial in a preferred implementation manner according to Embodiment 2 of the disclosure.

Referring to FIG. 10, FIG. 10 is a partial sectional view of a three-dimensional structure metamaterial in a preferred implementation manner according to Embodiment 2 of the disclosure. In FIG. 10, a three-dimensional structure metamaterial includes multiple layers of formed substrates 10, flexible function layers 20 that fit surfaces of the formed substrates 10 closely, where each flexible function layer includes a flexible substrate 21 formed of at least one flexible subsubstrate 210 and multiple artificial microstructures 22 that are disposed on the surface of each flexible subsubstrate 210 and capable of responding to an electromagnetic wave, and the three-dimensional structure metamaterial has an electromagnetic wave modulation function.

In an implementation manner of Embodiment 2 of the disclosure, the three-dimensional structure metamaterial may include at least two flexible function layers and at least two layers of the formed substrate. In a preferred implementation manner, FIG. 10 includes three layers of formed substrates 10 and two flexible function layers 20. The multiple layers of formed substrates 10 lead to higher mechanical performance of the three-dimensional structure metamaterial. In addition, the multiple flexible function layers 20 lead to electromagnetic coupling between adjacent flexible function layers 20. By optimizing a distance between the adjacent flexible function layers 20, the responsivity of the entire three-dimensional structure metamaterial to an electromagnetic wave is optimized. The distance between the adjacent flexible function layers 20 is a thickness of the formed substrate 10. Therefore, the thickness of each formed substrate 10 is adjustable as required. That is, the formed substrates 10 may be the same or different in thickness.

Figure 11:
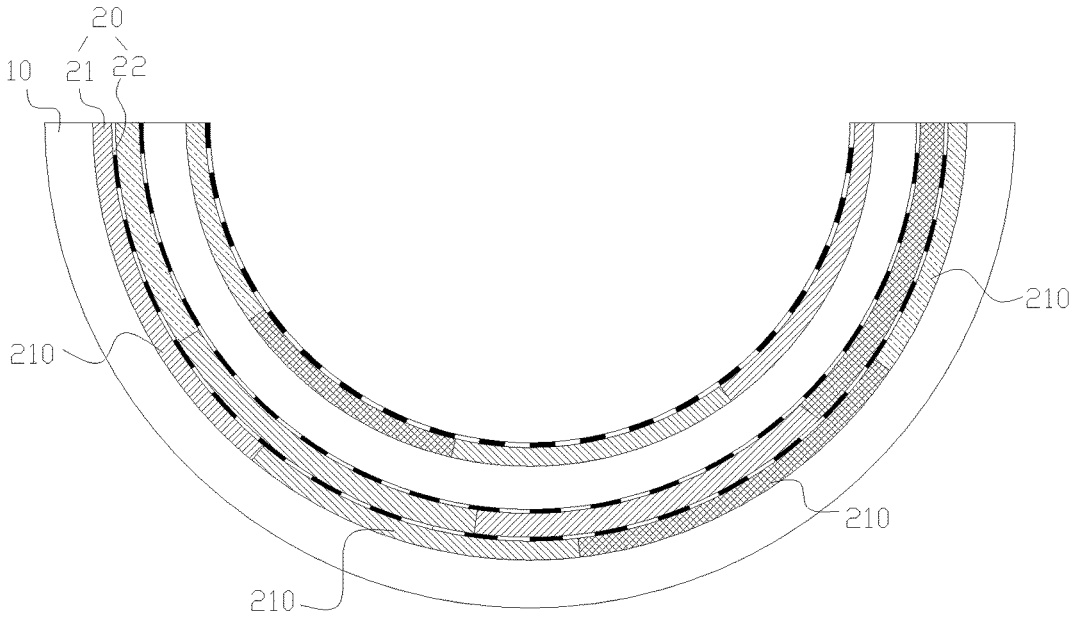
FIG. 11 is a partial sectional view of a three-dimensional structure metamaterial in another preferred implementation manner according to Embodiment 2 of the disclosure.

As shown in FIG. 10, when the three-dimensional structure metamaterial includes multiple flexible function layers 20, the flexible function layers 20 and the formed substrates 10 are spaced alternatively. In another implementation manner of Embodiment 2 of the disclosure, as shown in FIG. 11, when multiple flexible function layers 20 are included between the two layers of formed substrates 10 of the three-dimensional structure metamaterial, each flexible function layer 20 is disposed in a close-fitting manner, and the close-fitted flexible function layers are disposed on the surfaces of the formed substrates 10.

Embodiment 1

The three-dimensional structure metamaterial may be prepared in the following manner:

(1) Analyze the Gaussian curvature change of a curved surface of an emulated model of the three-dimensional structure metamaterial, and divide the emulated model of the three-dimensional structure metamaterial into multiple geometric areas according to the Gaussian curvature.

Figure 12:
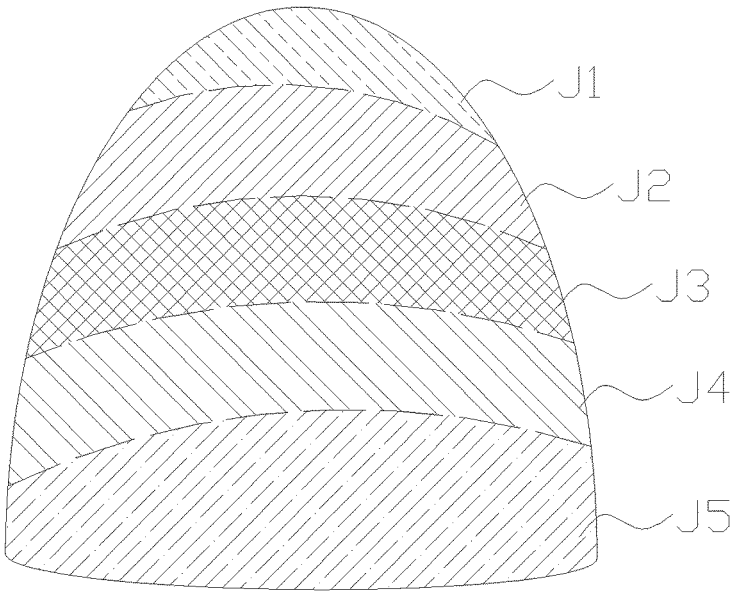
FIG. 12 is a schematic division diagram of geometric areas of an emulated model of a three-dimensional structure metamaterial in an implementation manner according to Embodiment 2 of the disclosure.

Referring to FIG. 12, FIG. 12 is a division diagram of geometric areas of an emulated model of a three-dimensional structure metamaterial according to this embodiment. In FIG. 12, the geometric areas of the same filler pattern represent areas of similar curvatures. In this embodiment, according to a division manner in which the ratio of the maximum Gaussian curvature to the minimum Gaussian curvature in each geometric area is less than 20, the emulated model of the three-dimensional structure metamaterial is divided into five geometric areas J1-J5.

(2) Expand the curved surface.

Figure 13:
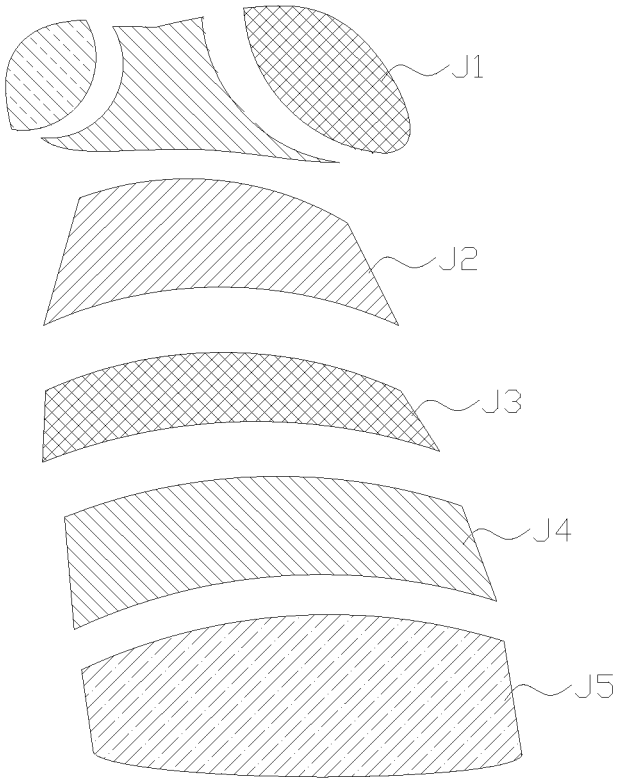
FIG. 13 is a planar diagram of expanding the geometric areas shown in FIG. 12.

Expanding the curved surface refers to expanding the geometric area of the curved surface in FIG. 12 into a plane and obtaining the size of the plane generated by expansion. The curved surface may be expanded into a plane in many ways to obtain the plane. Multiple pieces of design software can implement such a function, for example, solidworks software, Pro/Engineer software, and the like. FIG. 13 is a planar diagram of expanding the geometric areas of the curved surface shown in FIG. 12.

(3) Arrange artificial microstructures on a flexible substrate, and cut the flexible substrate into multiple flexible subsubstrates according to the plane size of the surface flattening.

Figure 14:
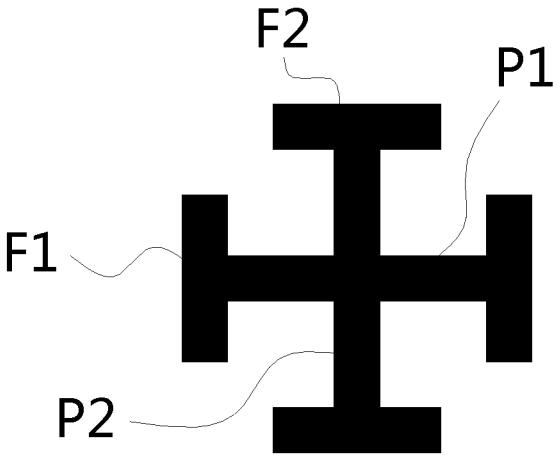
FIG. 14 is a schematic diagram of a topological shape of an artificial microstructure in an implementation manner according to Embodiment 2 of the disclosure.

In this embodiment, the artificial microstructures are arranged onto the flexible substrate by means of exposure, development and etching. The material of the flexible substrate may be a polyimide, polyester, polytetrafluoroethylene, polyurethane, polyarylate, PET film, PE film or PVC film, or the like. The topological shape of the artificial microstructures is designed according to the function that needs to be ultimately implemented by the three-dimensional structure metamaterial. In this embodiment, as shown in FIG. 14, the topological shape of the artificial microstructures includes a first metal wire P1 and a second metal wire P2 that bisect each other perpendicularly. Both ends of the first metal wire P1 are connected to two first metal legs F1 of the same length, and both ends of the first metal wire P1 are connected at a midpoint of the two first metal legs F1; both ends of the second metal wire P2 are connected to two second metal legs F2 of the same length, and both ends of the second metal wire P2 are connected at a midpoint of the two second metal legs F2. The first metal leg F1 is equal to the second metal leg F2 in length.

(4) Prepare the three-dimensional structure metamaterial.

Multiple sheets of quartz fiber-reinforced epoxy prepreg are laid in a mold to generate a layer of formed substrate, where the mold is a product of processing according to an emulated model of the three-dimensional structure metamaterial. A flexible subsubstrate is attached onto a corresponding area on the surface of the formed substrate. Multiple sheets of quartz fiber-reinforced epoxy prepreg are laid again on the flexible subsubstrate, and the foregoing steps are repeated until a three-dimensional structure metamaterial that has multiple layers of formed substrates and multiple layers of flexible substrates is obtained. After mold clamping, curing continues for 3 hours under conditions of a temperature of 100-200° C. and a vacuum degree of 0.5-1.0 MPa, and demolding is performed to obtain the three-dimensional structure metamaterial. In this embodiment, the multiple layers of formed substrates are the same in thickness.

Embodiment 2

The three-dimensional structure metamaterial may be prepared in the following manner:

(1) Calculate one or more electromagnetic parameter values at each place of the emulated model of the three-dimensional structure metamaterial.

The electromagnetic parameters may be an incident angle of an electromagnetic wave, an axial ratio, a phase value, or an electrical field incident angle of the electromagnetic wave and the like. Which electromagnetic parameter values are selected depends on the function that needs to be implemented by the three-dimensional structure metamaterial. In this embodiment, the three-dimensional structure metamaterial needs to implement the same electromagnetic response to electromagnetic waves at different incident angles. The electromagnetic response may be electromagnetic wave absorbing, electromagnetic wave penetration, polarization conversion, and the like. In this embodiment, the electromagnetic response is electromagnetic wave penetration.

Figure 15:
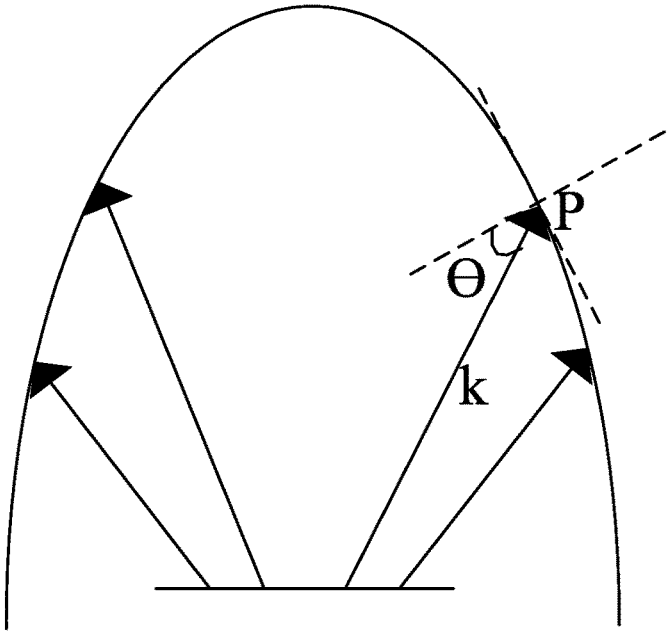
FIG. 15 is a schematic diagram of an incident angle of an electromagnetic wave that is incident into a point P on a surface of a three-dimensional structure metamaterial according to Embodiment 2 of the disclosure.

FIG. 15 shows a manner of calculating a wavevector incident angle of an electromagnetic wave that is incident into a point P on a surface of the three-dimensional structure metamaterial. In FIG. 15, the incident angle of the electromagnetic wave is a angle θ between the direction of the electromagnetic wave wavevector K and a normal line of a tangent plane corresponding to the point P.

(2) Divide the three-dimensional structure metamaterial into multiple electromagnetic areas according to the incident angle value.

Figure 16:
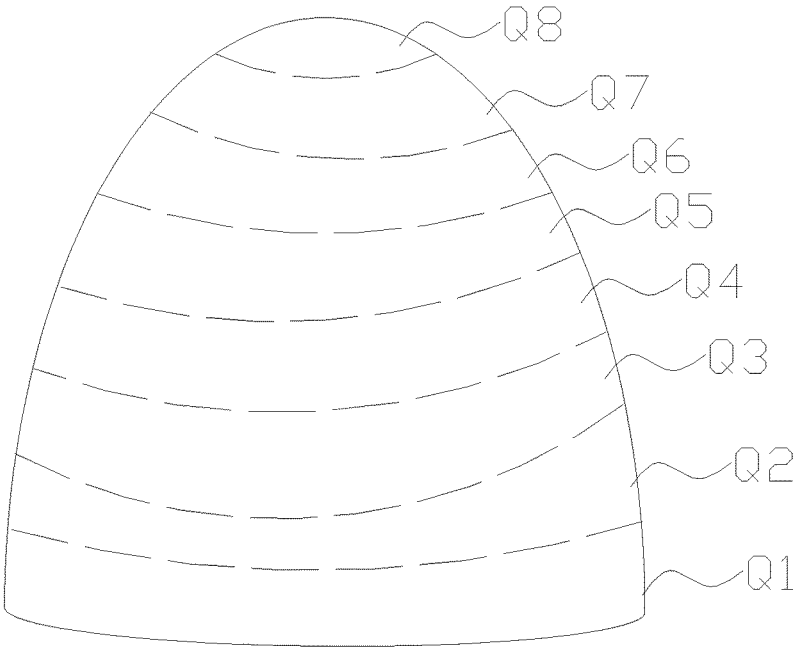
FIG. 16 is a schematic division diagram of electromagnetic areas of a three-dimensional structure metamaterial in an implementation manner according to Embodiment 2 of the disclosure.

FIG. 16 shows a division manner of electromagnetic areas of the three-dimensional structure metamaterial in this embodiment. In FIG. 16, the surface of the three-dimensional structure metamaterial is divided into eight electromagnetic areas Q1-Q8 at intervals of 11° of the incident angle. That is, the electromagnetic area Q1 corresponds to electromagnetic waves whose incident angles are 0°-11°, the electromagnetic area Q2 corresponds to electromagnetic waves whose incident angles are 12°-23°, and the electromagnetic area Q4 corresponds to electromagnetic waves whose incident angles are 24°-35°, and so on.

(3) Design the shape of the artificial microstructures in each electromagnetic are according to information about the incident angle range of electromagnetic waves in each electromagnetic area.

Because the span of the incident angle range of the electromagnetic waves in each electromagnetic area is small, it is simple to design artificial microstructures in view of the electromagnetic area. For example, when no division into electromagnetic area is performed, it is necessary to find an artificial microstructure that implements an electromagnetic response to all electromagnetic waves whose incident angle range is 0°-88°, which obviously increases the design difficulty of the artificial microstructures massively or even makes the design impracticable. After the division into electromagnetic areas is performed, for a first electromagnetic area Q1, it is only necessary to design an artificial microstructure that implements an electromagnetic response to electromagnetic waves whose incident angle range is 0°-11°; and, for a second electromagnetic area Q2, it is only necessary to design another artificial microstructure that implements an electromagnetic response to electromagnetic waves whose incident angle range is 12°-23°, and so on. This design manner reduces design difficulty of the artificial microstructures, and makes it practicable to enable the three-dimensional structure metamaterial to satisfy the requirement of implementing an electromagnetic response to all electromagnetic waves with a very wide incident angle range.

In this embodiment, each electromagnetic area corresponds to a topological shape of artificial microstructures, and the artificial microstructures in each electromagnetic area have the same topological shape but different sizes. The artificial microstructures with different sizes can satisfy the electromagnetic response requirements of this electromagnetic area, thereby reducing craft difficulty.

Figure 17:
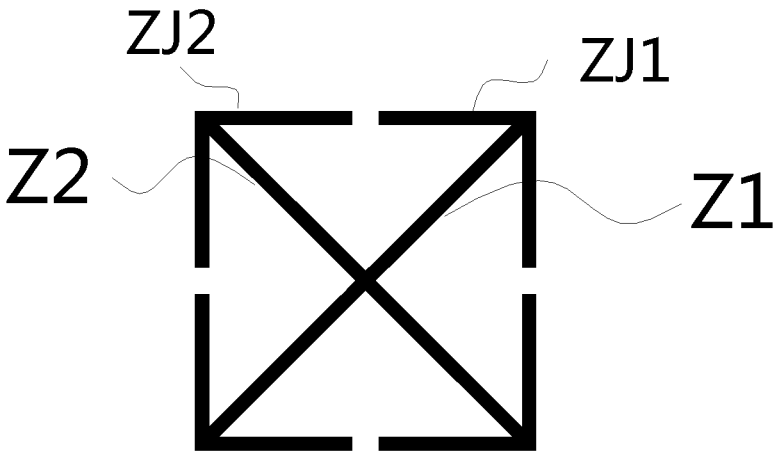
FIG. 17 is a schematic diagram of a topological shape of an artificial microstructure in another implementation manner according to Embodiment 2 of the disclosure.

In this embodiment, the topological shape of artificial microstructures corresponding to each electromagnetic area may be shown in FIG. 17. In FIG. 17, the geometric pattern has a first main line Z1 and a second main line Z2 that bisect each other perpendicularly. The first main line Z1 and the second main line Z2 have a same shape and size. Both ends of the first main line Z1 are connected to two same first right-angled angular lines ZJ1, and both ends of the first main line Z1 are connected at a bend of the two first right-angled angular lines ZJ1. Both ends of the second main line Z2 are connected to two second right-angled angular lines ZJ2, and both ends of the second main line Z2 are connected at a bend of the two second right-angled angular lines ZJ2. The first right-angled angular line ZJ1 and the second right-angled angular line ZJ2 have a same shape and size. Two arms of the first right-angled angular line ZJ1 and the second right-angled angular line ZJ2 are parallel to a horizontal line. The first main Z1 and the second main line Z2 are angular bisectors of the first right-angled angular line ZJ1 and the second right-angled angular line ZJ2 respectively. The geometric pattern may also be other shapes such as a splayed annular shape, a cross shape, an I-shape, a diamond shape, a hexagonal shape, a hexagonal ring shape, a cross-hole shape, a cross ring shape, a Y-hole shape, a Y-ring shape, a round-hole shape, or an annular shape.

(4) Analyze the Gaussian curvature change of a curved surface of an emulated model of the three-dimensional structure metamaterial, and divide the emulated model of the three-dimensional structure metamaterial into multiple geometric areas according to the Gaussian curvature.

The division manner of the geometric areas in this embodiment is the same as that in Embodiment 1. The ratio of the maximum Gaussian curvature to the minimum Gaussian curvature in each geometric area is generally less than 100, and may also be less than 80, less than 50 or less than 30 or the like. Preferably, the ratio of the maximum Gaussian curvature to the minimum Gaussian curvature in each geometric area is less than 20. Further preferably, the ratio of the maximum Gaussian curvature to the minimum Gaussian curvature in each geometric area is less than 10.

(5) Expand the curved surface.

The manner of expanding the curved surface is the same as that in Embodiment 1.

(3) Arrange artificial microstructures on a flexible substrate, and cut the plane size, which is obtained by expanding the flexible substrate according to the curved surface, into multiple flexible subsubstrates.

Figure 18:
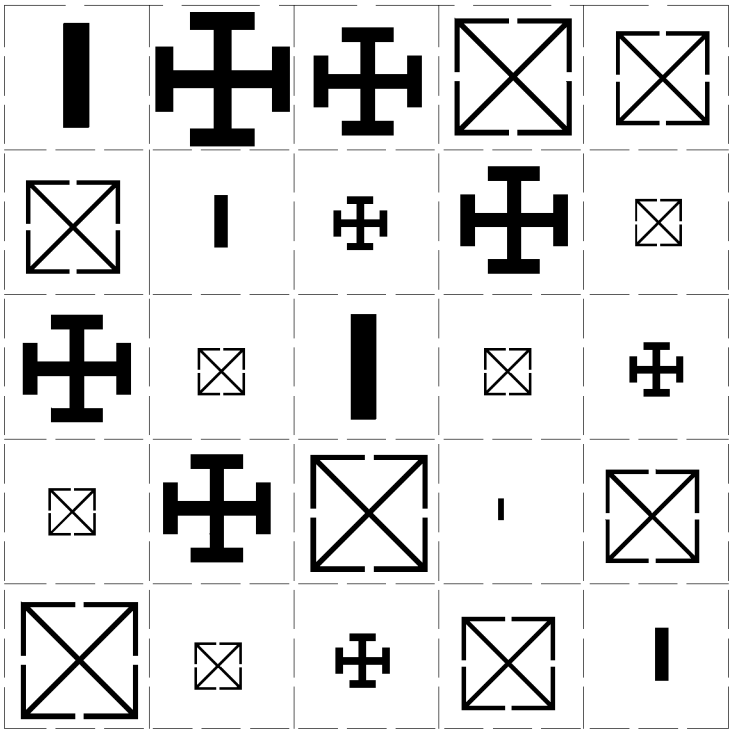
FIG. 18 is a schematic layout diagram of artificial microstructures in some areas on a specific flexible subsubstrate in an implementation manner according to Embodiment 2 of the disclosure.

In this embodiment, the layout of the artificial microstructures on the flexible substrate is obtained according to step (3). Therefore, the artificial microstructures at different places on the flexible substrate are not completely the same. When the flexible substrate is cut into multiple flexible subsubstrates, if an electromagnetic area exactly covers a flexible subsubstrate, the artificial microstructures on this flexible subsubstrate have the same shape but different sizes; and, if an electromagnetic area covers multiple flexible subsubstrates, the shapes and sizes of the artificial microstructures on each flexible subsubstrate are not completely the same. FIG. 18 is a schematic layout diagram of artificial microstructures in some areas on a flexible subsubstrate.

In this embodiment, the artificial microstructures are arranged onto the flexible substrate by means of laser engraving.

(4) Prepare the three-dimensional structure metamaterial.

Carbon fiber-reinforced plastic is laid in a mold, where the mold is a product of processing according to an emulated model of the three-dimensional structure metamaterial.

The carbon fiber-reinforced plastic is coated with polyester resin evenly, and the coating the carbon fiber-reinforced plastic with polyester resin is repeated. Subsequently, the multiple layers of carbon fiber-reinforced plastic coated with polyester resin are placed into an oven, and are cured under a 100° C. temperature for 10 minutes to obtain a formed substrate.

A flexible subsubstrate is attached onto a corresponding area on the surface of the formed substrate.

A flexible subsubstrate is attached onto a corresponding area on the surface of the formed substrate.

The flexible subsubstrate is overlaid with a formed substrate again. In this embodiment, the formed substrates are different in thickness.

Vacuum curing continues for 5 hours under a 200° C. temperature, and then demolding is performed to obtain the three-dimensional structure metamaterial.

Embodiment 3

The three-dimensional structure metamaterial may be prepared in the following manner:

(1) Calculate one or more electromagnetic parameter values at each place of the emulated model of the three-dimensional structure metamaterial.

The electromagnetic parameters may be an incident angle of an electromagnetic wave, an axial ratio, a phase value, or an electrical field incident angle of the electromagnetic wave and the like. Which electromagnetic parameter values are selected depends on the function that needs to be implemented by the three-dimensional structure metamaterial. In this embodiment, the three-dimensional structure metamaterial needs to implement polarization conversion, that is, convert all electromagnetic waves with different electrical field incident angles into a desired polarization mode, that is, a desired electrical field emergent angle.

A manner of determining an electrical field incident angle is similar to a manner of determining an incident angle of the electromagnetic wave in Embodiment 2, and a difference is that the incident angle needs to be changed to the electrical field incident angle.

(2) Divide the three-dimensional structure metamaterial into multiple electromagnetic areas according to the electrical field incident angle value.

In this embodiment, the span of the electrical field incident angle of each electromagnetic area may be different. For example, when it is known that a microstructure is well electromagnetically responsive to electromagnetic waves whose electrical field incident angles are 0°-30°, the electrical field incident angles 0°-30° may be used as an electromagnetic area, and other electromagnetic areas may still be arranged according to a 10° span of the electrical field incident angle.

(3) The shape of the artificial microstructures in each electromagnetic area is designed according to information about the electrical field incident angle range of electromagnetic waves in each electromagnetic area.

In this embodiment, the artificial microstructures need to change an electrical field emergent angle. Therefore, the artificial microstructures in different electromagnetic areas need to enable the electromagnetic area to satisfy the electrical field direction angle difference of the corresponding electromagnetic area.

Similar to Embodiment 2, due to division into electromagnetic areas, it is practicable and easy to design the artificial microstructures capable of satisfying the electrical field direction angle difference in an electromagnetic area alone.

(4) Arrange the artificial microstructures designed in step (3) onto a flexible substrate.

(5) Prepare the three-dimensional structure metamaterial.

Multiple sheets of aramid fiber-reinforced cyanate prepreg are laid in a mold to generate a layer of formed substrate, where the mold is a product of processing according to an emulated model of the three-dimensional structure metamaterial. Holes or slots are opened on the flexible substrate which is made in step (4) and onto which artificial microstructures are attached, and then the flexible substrate is attached onto the surface of the formed substrate. Aramid fiber-reinforced cyanate prepregs are laid again on the flexible substrate, and the foregoing steps are repeated until a three-dimensional structure metamaterial that has multiple layers of formed substrates and multiple layers of flexible substrates is obtained. After mold clamping, curing continues for 5 hours under conditions of a 300° C. temperature and a vacuum degree of 2.0 MPa, and demolding is performed to obtain the three-dimensional structure metamaterial.

At the time of curing the three-dimensional structure metamaterial into a shape after slots or holes are opened on the flexible substrate, some materials of the formed substrates stuffed between the slots or holes are also cured into a shape, which leads to close connections between adjacent formed substrates. In this way, the structure is simple, and no other structure or step is required additionally. When the formed substrate is shaped, the structure for strengthening the bonding force between layers may be generated at the same time.

In each of the foregoing implementation manners, the fiber is primarily used to reinforce the mechanical strength of the made three-dimensional structure metamaterial. Therefore, the fiber is not limited to the quartz fiber, carbon fiber, and aramid fiber enumerated in Embodiment 1 to Embodiment 3, and may also be a glass fiber, a polyethylene fiber, a polyester fiber, or the like. The resin is also not limited to the epoxy, polyester resin and cyanate enumerated in Embodiment 1 to Embodiment 3. The resin may also be all kinds of thermosetting resin, for example, epoxy resin, cyanate resin, bismaleimide resin, and modified resin thereof or a mixed system thereof, and may also be all kinds of thermoplastic resin, for example, polyimide, polyether ether copper, polyether ether imide, polyphenylene sulfide, or polyester, or the like.

The material of the artificial microstructures may be a metal conductive material or a nonmetal conductive material, where the metal conductive material may be gold, silver, copper, aluminum, zinc, or the like, or may be various gold alloys, aluminum alloys, zinc alloys, and the like, and the nonmetal conductive material may be a conductive graphite, an indium tin oxide, or an aluminum-doped zinc oxide, or the like.

Embodiment 3

Figure 19:
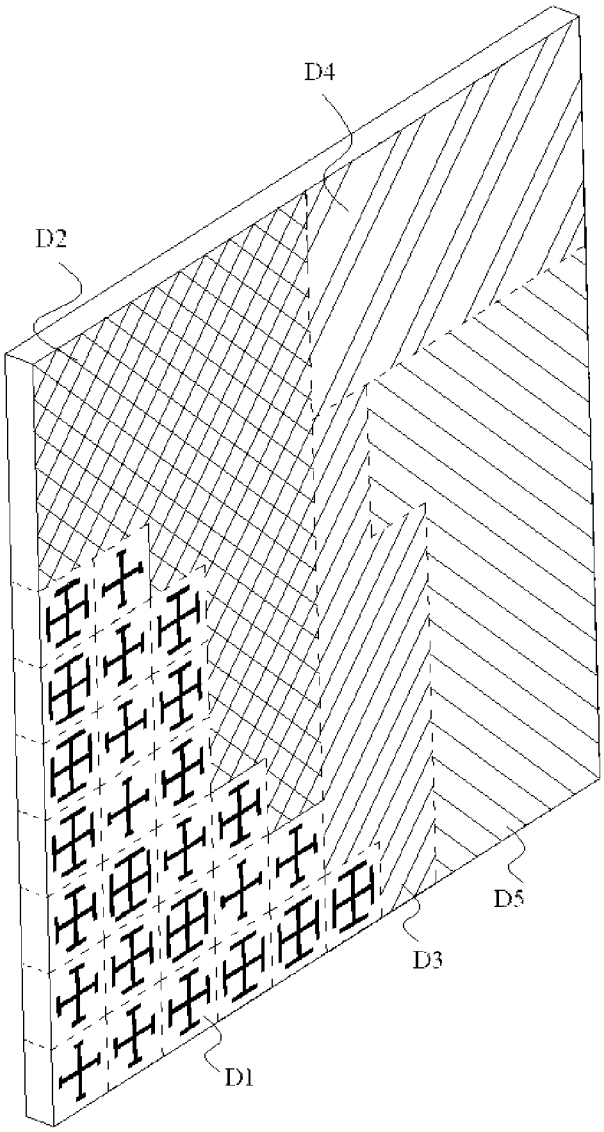
FIG. 19 is a stereoscopic structural diagram of a metamaterial in a preferred implementation manner according to the disclosure.

Referring to FIG. 19, FIG. 19 is a stereoscopic structural diagram of a metamaterial in a preferred implementation manner according to Embodiment 3 of the disclosure. In FIG. 19, the metamaterial includes a substrate 10 and multiple artificial microstructures 11 arranged on a surface of the substrate 10. Multiple electromagnetic areas D1, D2, D3, D4, and D5 are included on the metamaterial. In FIG. 19, multiple artificial microstructures 11 are arranged on the electromagnetic area D1, and other electromagnetic areas are filled with different filler patterns for a purpose of distinguishing. However, multiple artificial microstructures are also disposed in other electromagnetic areas. Each electromagnetic area corresponds to one or more electromagnetic parameter ranges of an electromagnetic wave that is incident into this electromagnetic area.

In FIG. 19, the surface of the substrate 10 is a plane. The method for disposing artificial microstructures on a surface of the substrate 10 may be etching, diamond etching, engraving, electroetching, or ion etching, or the like.

Figure 20:
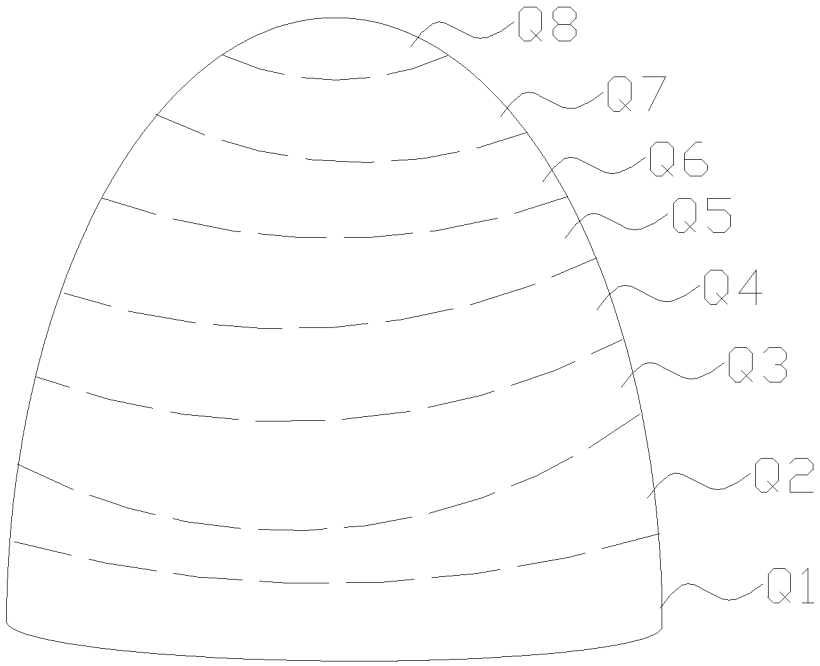
FIG. 20 is a stereoscopic structural diagram of a metamaterial in another preferred implementation manner according to Embodiment 3 of the disclosure.
Figure 21:
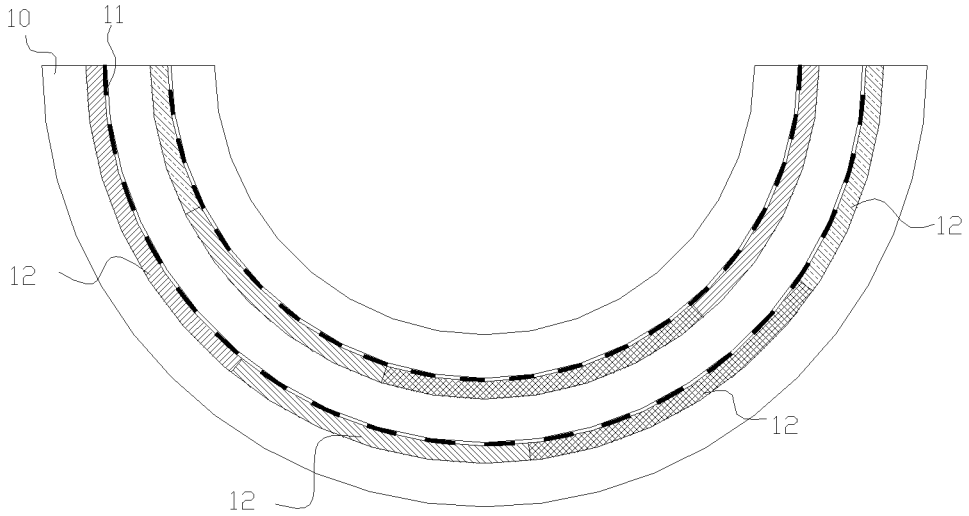
FIG. 21 is a partial sectional view of the metamaterial shown in FIG. 20.
Figure 22:
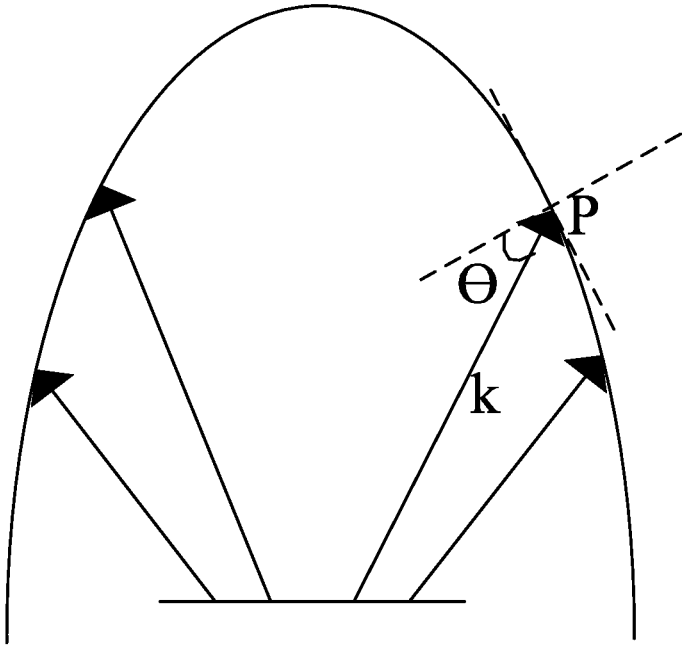
FIG. 22 is a schematic diagram of an incident angle of an electromagnetic wave that is incident into a point P on a surface of the metamaterial shown in FIG. 20.

Referring to FIG. 20 and FIG. 21, FIG. 20 is a stereoscopic structural diagram in another preferred implementation manner according to Embodiment 3 of the disclosure. FIG. 21 is a partial sectional view of the metamaterial shown in FIG. 20. From FIG. 20 and FIG. 21, it can be learned that the surface of the metamaterial substrate 10 in this embodiment is a curved surface. The metamaterial in this embodiment is divided into 8 electromagnetic areas Q1-Q8 according to information about the incident angle range. The incident angle of an electromagnetic wave that is incident into a point P on the surface of the metamaterial in this embodiment is obtained in the manner shown in FIG. 22. In FIG. 22, the incident angle θ of the electromagnetic wave on the point P is calculated according to information about an electromagnetic wave wavevector K and a normal line N of a tangent plane corresponding to the point P. The incident angle value at each place is obtained according to the incident angle calculation manner shown in FIG. 22. In this embodiment, the eight electromagnetic areas are a result of dividing at intervals of 11° of the incident angle. That is, the incident angles 0°-11° are incorporated into the electromagnetic area Q1, the incident angles 12°-23° are incorporated into the electromagnetic area Q2, the incident angles 24°-35° are incorporated into the electromagnetic area Q3, and so on. In this embodiment, the difference between a maximum value and a minimum value of the incident angle is the same between the electromagnetic areas, so as to simplify design. However, on some occasions, for example, when it is known that a topology of an artificial microstructure is well electromagnetically responsive to electromagnetic waves whose incident angles are 0°-30°, the surface may be divided into electromagnetic areas onto which the incident angles are 0°-30°, 31°-40°, 41°-50°, and so on. The specific division manner may be set according to specific requirements, and is not limited in the disclosure.

The shape of the artificial microstructures in each electromagnetic area is designed according to information about the incident angle range of each electromagnetic area so that requirements are satisfied, for example, requirements of absorbing electromagnetic waves, being penetrated by electromagnetic waves, and the like. Because the span of the incident angle range in each electromagnetic area is small, it is simple to design artificial microstructures in view of the electromagnetic area. In a preferred embodiment, the artificial microstructures in each electromagnetic area have the same topology but different sizes. With a gradient of the sizes of the artificial microstructures of the same topology, the artificial microstructures can satisfy electromagnetic response requirements of an electromagnetic area. This design manner simplifies the process and reduces design costs. Understandably, the topologies and the sizes of the artificial microstructures in each electromagnetic area may also be different so long as the electromagnetic response required by the incident angle range corresponding to the electromagnetic area is satisfied.

The foregoing has described a manner of dividing a metamaterial of a curved surface substrate into electromagnetic areas according to an incident angle. Understandably, when the surface is a plane, it is easier to divide the surface into electromagnetic areas according to the incident angle.

Because electromagnetic parameters capable for representing electromagnetic waves are diversified, in FIG. 20 to FIG. 22, the function that needs to be implemented by the metamaterial is to enable all electromagnetic waves that are incident at a large angle to have the same electromagnetic response such as large-angle wave absorbing, large-angle wave transmission, and the like. When the metamaterial needs to implement other functions, the electromagnetic waves are represented by other electromagnetic parameters, and the electromagnetic areas are generated according to the electromagnetic parameters.

For example, when the metamaterial needs to implement a beam forming function, a phase value is used to represent the electromagnetic waves that are incident into the surface of the metamaterial. A proper phase value range is selected to divide the metamaterial into multiple electromagnetic areas. The ultimately required phase at each place of the metamaterial is calculated according to the function that needs to be ultimately implemented by the beam forming, such as electromagnetic wave convergence, electromagnetic wave divergence, electromagnetic wave deflection, conversion from a spherical wave into a plane wave. The artificial microstructures are arranged in each electromagnetic area so that the electromagnetic area can satisfy the phase difference corresponding to the electromagnetic area.

For another example, when the metamaterial needs to implement polarization conversion, an axial ratio or an electrical field incident angle of electromagnetic waves is used to represent the electromagnetic waves that are incident into the surface of the metamaterial. A person skilled in the art understands that a polarization mode of an electromagnetic wave is an electrical field direction of the electromagnetic wave, and a polarization effect is represented by an axial ratio. A manner of determining an electrical field incident angle of the electromagnetic wave is similar to a manner of determining an incident angle of the electromagnetic wave in FIG. 22, and is determined by only changing the direction of the wavevector K in FIG. 22 into the direction of the electrical field E. The surface of the metamaterial is divided into multiple electromagnetic areas according to information about the electrical field incident angle of the electromagnetic wave. The ultimately required electrical field direction at each place of the metamaterial is determined according to the function that needs to be ultimately implemented by the polarization conversion, such as conversion into vertical polarization, conversion into horizontal polarization, conversion into circular polarization, and the like. The artificial microstructures are arranged in each electromagnetic area so that the electromagnetic area can satisfy the angle difference of the electrical field direction corresponding to the electromagnetic area.

If the metamaterial needs to satisfy two or more electromagnetic parameters, for example, a large angle of responding to electromagnetic waves by the metamaterial and needs to satisfy beam forming are needed, then the surface of the metamaterial may be divided into multiple electromagnetic fields that can satisfy the two electromagnetic parameters.

The artificial microstructures may be processed on each electromagnetic area of a curved-surface metamaterial by means of conventional three-dimensional laser engraving, three-dimensional etching, and the like. However, in the three-dimensional processing, the device cost is high and the craft precision is not well controlled. In Embodiment 3 of the disclosure, in order to solve the processing problem of artificial microstructures in each electromagnetic area of the curved-surface metamaterial, the curved-surface metamaterial is expanded into multiple geometric areas, and then the artificial microstructures in the corresponding electromagnetic area are processed in each geometric area.

Referring to FIG. 21 again. In arranging the artificial microstructures of the corresponding electromagnetic area in a geometric area, the artificial microstructures may be arranged on the flexible substrate 12 first. Each flexible substrate corresponds to a plane generated by expanding a geometric area. Subsequently, multiple flexible substrates are attached onto the substrate to achieve an effect of arranging the artificial microstructures on the substrate.

In this embodiment, the surface of the metamaterial is divided into multiple geometric areas in the following manner: analyzing a Gaussian curvature distribution on the surface of the metamaterial, and a part with a similar Gaussian curvature distribution forms a geometric area. If the surface is divided into more geometric areas, the probability of generating wrinkles when the flexible substrate in a corresponding geometric area is attached onto the surface of the substrate is lower, the required craft precision is higher, but processing and formation are more difficult. To achieve a trade-off between the two, the surface of the metamaterial is generally divided into 5-15 geometric areas according to the Gaussian curvature. A ratio of a maximum Gaussian curvature to a minimum Gaussian curvature of the entire metamaterial is used as a reference. In division into the geometric areas, the ratio of the maximum Gaussian curvature to the minimum Gaussian curvature in each geometric area is generally less than 100, but may also be less than 80, less than 50 or less than 30, or the like. Preferably, the ratio of the maximum Gaussian curvature to the minimum Gaussian curvature in each geometric area is less than 20. Further preferably, the ratio of the maximum Gaussian curvature to the minimum Gaussian curvature in each geometric area is less than 10.

Figure 23:
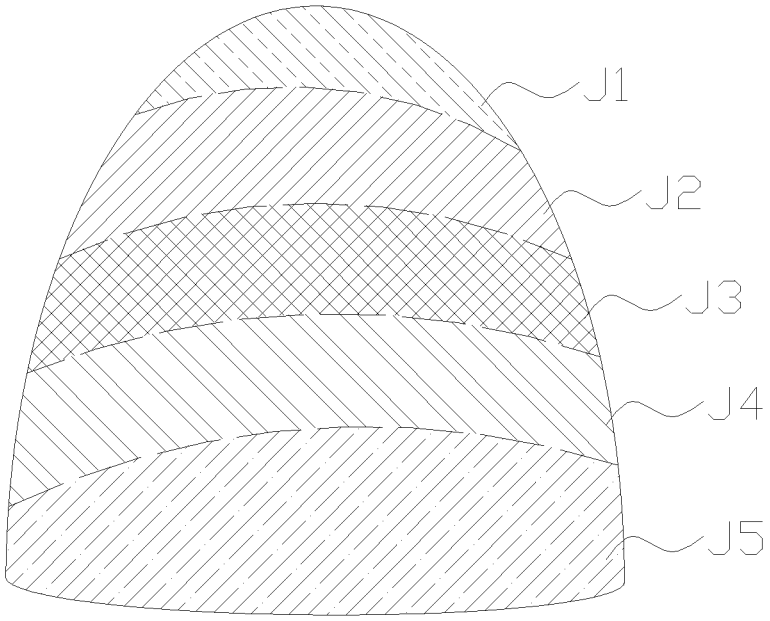
FIG. 23 is a schematic diagram of dividing a metamaterial into multiple geometric areas according to a Gaussian curvature in a preferred implementation manner according to Embodiment 3 of the disclosure.
Figure 24:
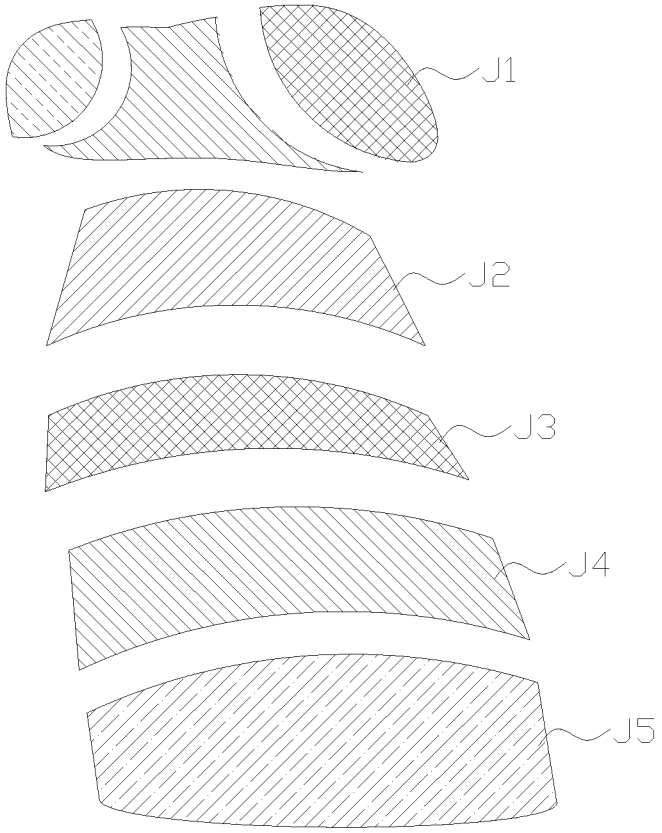
FIG. 24 is a schematic diagram of expanding the geometric areas shown in FIG. 23 into planes.

FIG. 23 is a schematic diagram of dividing a metamaterial into multiple geometric areas according to a Gaussian curvature in a preferred embodiment. In FIG. 23, the metamaterial is divided into 5 geometric areas J1-J5 according to the Gaussian curvature. FIG. 24 is a schematic diagram of 5 planes P1-P5 generated by expanding 5 geometric areas in FIG. 23. Preferably, in FIG. 24, to facilitate making, a relatively long geometric area is cut into multiple subplanes.

A flexible substrate of a corresponding size is cut according to the plane generated by expansion, and artificial microstructures are processed on the flexible substrate. Subsequently, multiple flexible substrates, on which the artificial microstructures are arranged, are attached onto a corresponding surface of the substrate according to the geometric areas generated above, so as to form a metamaterial. In this embodiment, the artificial microstructures are generated on the flexible substrate. Therefore, a conventional panel metamaterial preparation method may be applied instead of such methods as three-dimensional etching and engraving, which saves costs. In addition, division into areas in this embodiment ensures that, when multiple flexible substrates are spliced, the multiple flexible substrates do not generate wrinkles. That is, the artificial microstructures will not be distorted, which ensures craft precision of the metamaterial.

The artificial microstructures may be structures that are formed of a conductive material and have a geometric pattern. The topological shape of the artificial microstructures may be obtained by means of computer emulation. It is appropriate to design different artificial microstructure topologies for different electromagnetic response requirements.

Figure 25:
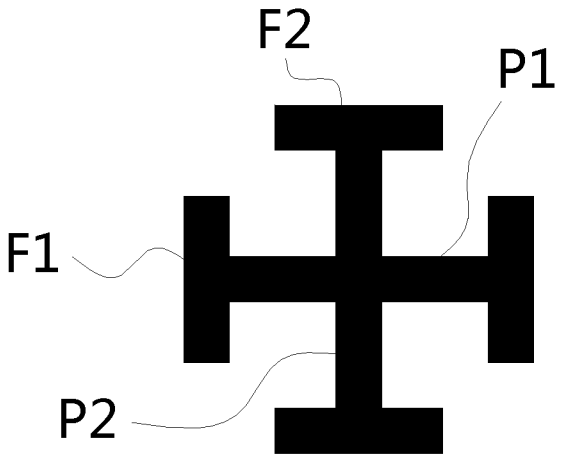
FIG. 25 is a schematic diagram of a crossed snowflake-shaped artificial microstructure according to Embodiment 3 of the disclosure.

The geometric pattern may be a crossed snowflake shape shown in FIG. 25. A crossed snowflake microstructure includes a first metal wire P1 and a second metal wire P2 that bisect each other perpendicularly. Both ends of the first metal wire P1 are connected to two first metal legs F1 of the same length, and both ends of the first metal wire P1 are connected at a midpoint of the two first metal legs F1; both ends of the second metal wire P2 are connected to two second metal legs F2 of the same length, and both ends of the second metal wire P2 are connected at a midpoint of the two second metal legs F2. The first metal leg F1 is equal to the second metal leg F2 in length.

Figure 26:
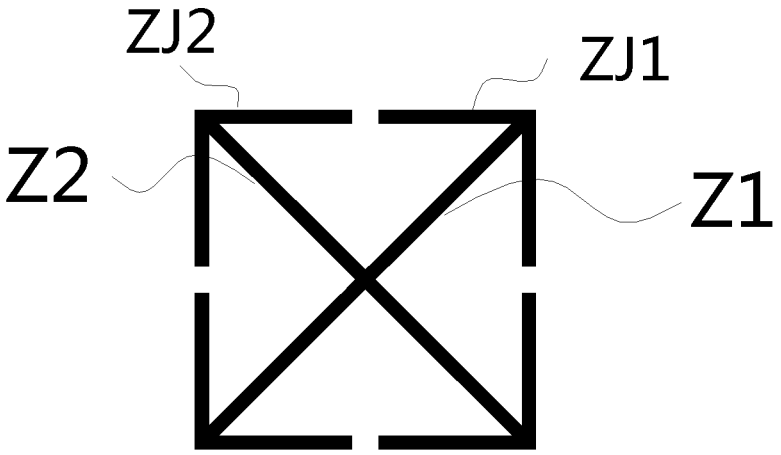
FIG. 26 is a schematic diagram of a topological shape of another artificial microstructure according to Embodiment 3 of the disclosure.

The geometric pattern may also be a geometric figure shown in FIG. 26. In FIG. 25, the geometric pattern has a first main line Z1 and a second main line Z2 that bisect each other perpendicularly. The first main line Z1 and the second main line Z2 have a same shape and size. Both ends of the first main line Z1 are connected to two same first right-angled angular lines ZJ1, and both ends of the first main line Z1 are connected at a bend of the two first right-angled angular lines ZJ1. Both ends of the second main line Z2 are connected to two second right-angled angular lines ZJ2, and both ends of the second main line Z2 are connected at a bend of the two second right-angled angular lines ZJ2. The first right-angled angular line ZJ1 and the second right-angled angular line ZJ2 have a same shape and size. Two arms of the first right-angled angular line ZJ1 and the second right-angled angular line ZJ2 are parallel to a horizontal line. The first main Z1 and the second main line Z2 are angular bisectors of the first right-angled angular line ZJ1 and the second right-angled angular line ZJ2 respectively. The geometric pattern may also be other shapes such as a splayed annular shape, a cross shape, an I-shape, a diamond shape, a hexagonal shape, a hexagonal ring shape, a cross-hole shape, a cross ring shape, a Y-hole shape, a Y-ring shape, a round-hole shape, or an annular shape.

The material of the artificial microstructures may be a metal conductive material or a nonmetal conductive material, where the metal conductive material may be gold, silver, copper, aluminum, zinc, or the like, or may be various gold alloys, aluminum alloys, zinc alloys, and the like, and the nonmetal conductive material may be a conductive graphite, an indium tin oxide, or an aluminum-doped zinc oxide, or the like.

A material of the substrate may be a ceramic material, a ferroelectric material, a ferrite material, or a macromolecular polymer material, where the polymer material is preferably an F4B material, an FR4 material or a PS material.

When the metamaterial substrate in Embodiment 3 of the disclosure is a curved-surface material or when a flexible substrate needs to be attached onto the substrate surface, the material of the substrate is preferably a prepreg formed of resin and reinforcing fibers. Before being cured into a shape, the prepreg is somewhat flexible and sticky, which makes it convenient to adjust the shape when processing the curved-surface metamaterial and convenient to attach the flexible substrate onto its surface. In addition, the prepreg has a high mechanical strength after being cured into a shape.

In the prepreg material, the resin may be thermosetting resin, for example, all kinds of epoxy resin, cyanate resin, bismaleimide resin, and modified resin thereof or a mixed system thereof, and may also be thermoplastic resin, for example, polyimide, polyether ether copper, polyether ether imide, polyphenylene sulfide, or polyester, or the like. The reinforcing fiber may be a glass fiber, a quartz fiber, an aramid fiber, a polyethylene fiber, a carbon fiber or a polyester fiber, or the like.

When the metamaterial is applied to products in a specific field, the metamaterial may be disposed according to the shape of the specific product so that the metamaterial becomes a fitting of the product. In addition, the metamaterial itself may constitute a major part of the product. For example, when the metamaterial is used for making a radome, the metamaterial may be used as a body of the radome directly, or the metamaterial is disposed on the surface of the radome body made of a conventional ordinary material to enhance electromagnetic performance of the original radome body.

According to different functions of the metamaterial, the metamaterial may be made into an antenna, a filter, a polarization converter, and the like, so as to satisfy different application requirements.

Figure 27:
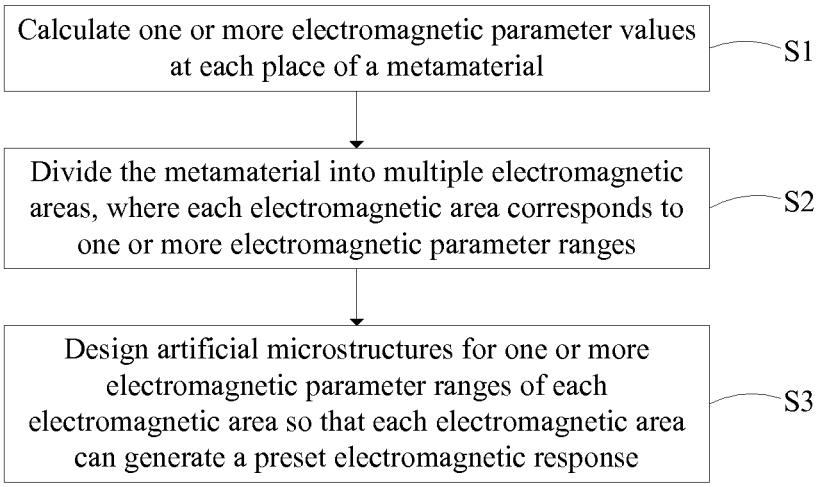
FIG. 27 is a step-by-step flowchart of a metamaterial design method according to Embodiment 3 of the disclosure.

According to Embodiment 3 of the disclosure, a metamaterial design method is further provided. As shown in FIG. 27, the designing steps include:

S1: Calculate one or more electromagnetic parameter values at each place of a metamaterial;

Depending on requirements, the electromagnetic parameters may be an incident angle, a phase, an axial ratio, an electrical field incident angle of the electromagnetic wave, and the like.

S2. Divide the metamaterial into multiple electromagnetic areas, where each electromagnetic area corresponds to one or more electromagnetic parameter ranges.

Differences between a maximum value and a minimum value of one or more electromagnetic parameter ranges corresponding to each electromagnetic area are equal or unequal.

S3. Design artificial microstructures for one or more electromagnetic parameter ranges of each electromagnetic area so that each electromagnetic area can generate a preset electromagnetic response.

Preferably, the artificial microstructures in each electromagnetic area have a same topological shape but different sizes. The artificial microstructures in different electromagnetic areas have different topological shapes.

Some embodiments of the disclosure have been described with reference to the attached drawings; however, the disclosure is not limited to the aforesaid embodiments, and these embodiments are merely illustrative but are not intended to limit the disclosure. Persons of ordinary skill in the art may further derive many other implementations according to the teachings of the disclosure and within the scope defined in the claims, and all of the implementations shall fall within the scope of the disclosure.

What is claimed is:

1. A metamaterial, comprising: at least one layer of substrate and multiple artificial microstructures, wherein the metamaterial comprises an electromagnetic area, and an artificial microstructure in the electromagnetic area generates a preset electromagnetic response to an electromagnetic wave that is incident into the electromagnetic area;

the metamaterial is a three-dimensional structure metamaterial, the substrate is a formed substrate, and the three-dimensional structure metamaterial comprises: at least one layer of formed substrate, and at least one flexible function layer, wherein the flexible function layer is disposed on a surface of the formed substrate or disposed between multiple layers of formed substrates; each flexible function layer comprises a flexible substrate formed of at least one flexible subsubstrate and multiple artificial microstructures that are disposed on each flexible subsubstrate and capable of responding to an electromagnetic wave, and the three-dimensional structure metamaterial has an electromagnetic wave modulation function;

the flexible function layer comprises multiple flexible subsubstrates, and one flexible subsubstrate corresponds to one plane generated by expanding the surface of the three-dimensional structure metamaterial;

wherein, on the flexible substrate, a structure for strengthening a bonding force between the flexible substrate and formed substrate layers adjacent to the flexible substrate is disposed.

2. The metamaterial according to claim 1, wherein the three-dimensional structure metamaterial comprises at least two flexible function layers and at least two layers of the formed substrate.

3. The metamaterial according to claim 2, wherein the formed substrate and the flexible function layer are spaced alternatively; each flexible substrate is disposed in a close-fitting manner, and the flexible function layer fits the surface of the formed substrate closely.

4. The metamaterial according to claim 1, wherein a ratio of a maximum Gaussian curvature to a minimum Gaussian curvature in the geometric areas expandable into planes on the surface of the three-dimensional structure metamaterial is less than 100.

5. The metamaterial according to claim 1, wherein the artificial microstructures on different flexible subsubstrates have a same topology.

6. The metamaterial according to claim 1, wherein the three-dimensional structure metamaterial comprises multiple electromagnetic areas, an electromagnetic wave that is incident into each electromagnetic area has one or more electromagnetic parameter ranges, and an artificial microstructure in each electromagnetic area generates a preset electromagnetic response to an electromagnetic wave that is incident into the electromagnetic area.

7. The metamaterial according to claim 6, wherein each electromagnetic area is located in one flexible sub substrate, or each electromagnetic area is located across multiple flexible subsubstrates.

8. The metamaterial according to claim 6, wherein the artificial microstructures on at least one flexible function layer in each electromagnetic area have a same topological shape but different sizes.

9. The metamaterial according to claim 6, wherein the artificial microstructures on the flexible function layer in each electromagnetic area have a same topological shape.

10. The three-dimensional structure metamaterial according to claim 1, wherein the structure is a hole or slot that is provided on the flexible substrate.

11. A three-dimensional structure metamaterial preparation method, comprising the following steps:

making a formed substrate according to a shape of a three-dimensional structure metamaterial; the metamaterial comprising: at least one layer of substrate and multiple artificial microstructures, wherein the metamaterial comprises an electromagnetic area, and an artificial microstructure in the electromagnetic area generates a preset electromagnetic response to an electromagnetic wave that is incident into the electromagnetic area;

the metamaterial is a three-dimensional structure metamaterial, the substrate is a formed substrate, and the three-dimensional structure metamaterial comprises: at least one layer of formed substrate, and at least one flexible function layer, wherein the flexible function layer is disposed on a surface of the formed substrate or disposed between multiple layers of formed substrates; each flexible function layer comprises a flexible substrate formed of at least one flexible subsubstrate and multiple artificial microstructures that are disposed on each flexible subsubstrate and capable of responding to an electromagnetic wave, and the three-dimensional structure metamaterial has an electromagnetic wave modulation function;

the flexible function layer comprises multiple flexible subsubstrates, and one flexible subsubstrate corresponds to one plane generated by expanding the surface of the three-dimensional structure metamaterial;

wherein, on the flexible substrate, a structure for strengthening a bonding force between the flexible substrate and formed substrate layers adjacent to the flexible substrate is disposed; the surface of the three-dimensional structure metamaterial is formed of at least two geometric areas expandable into planes;

arranging artificial microstructures onto a flexible substrate;

attaching the flexible substrate onto the formed substrate; and performing thermosetting formation;

the flexible substrate is attached onto the surface of the formed substrate in the following steps: expanding the three-dimensional structure metamaterial into multiple planes, cutting the flexible substrate into multiple flexible subsubstrates corresponding to the multiple planes, and attaching the flexible subsubstrates to a surface area corresponding to the formed substrate.

12. The preparation method according to claim 11, wherein the three-dimensional structure metamaterial comprises at least two layers of the flexible substrate and at least two layers of the formed substrate; the formed substrate and the flexible substrate are spaced alternatively; each flexible substrate is disposed in a close-fitting manner, and the flexible function layer fits the surface of the formed substrate closely.

13. The preparation method according to claim 11, wherein a ratio of a maximum Gaussian curvature to a minimum Gaussian curvature in the geometric areas expandable into planes on the surface of the three-dimensional structure metamaterial is less than 100.

14. The preparation method according to claim 11, wherein the artificial microstructures on different flexible subsubstrates have a same topology.

15. The preparation method according to claim 11, wherein a layout of the artificial microstructures on the flexible substrate is determined in the following steps: calculating one or more electromagnetic parameter values at different places of the three-dimensional structure metamaterial; dividing the three-dimensional structure metamaterial into multiple electromagnetic areas according to one or more of the electromagnetic parameter values, wherein each electromagnetic area corresponds to a parameter value range of one or more electromagnetic parameters; differences between a maximum value and a minimum value of electromagnetic wave parameter value ranges corresponding to each electromagnetic area are equal or unequal; and designing the artificial microstructures in each electromagnetic area so that a part of the three-dimensional structure metamaterial, which corresponds to the electromagnetic area, can generate a preset electromagnetic response to an electromagnetic wave that is incident into the electromagnetic area.

16. A metamaterial design method, comprising the following steps:

calculating one or more electromagnetic parameter values of an electromagnetic wave that is incident into each place of a metamaterial, the metamaterial comprising: at least one layer of substrate and multiple artificial microstructures, wherein the metamaterial comprises an electromagnetic area, and an artificial microstructure in the electromagnetic area generates a preset electromagnetic response to an electromagnetic wave that is incident into the electromagnetic area;

the metamaterial is a three-dimensional structure metamaterial, the substrate is a formed substrate, and the three-dimensional structure metamaterial comprises: at least one layer of formed substrate, and at least one flexible function layer, wherein the flexible function layer is disposed on a surface of the formed substrate or disposed between multiple layers of formed substrates; each flexible function layer comprises a flexible substrate formed of at least one flexible subsubstrate and multiple artificial microstructures that are disposed on each flexible subsubstrate and capable of responding to an electromagnetic wave, and the three-dimensional structure metamaterial has an electromagnetic wave modulation function;

the flexible function layer comprises multiple flexible subsubstrates, and one flexible subsubstrate corresponds to one plane generated by expanding the surface of the three-dimensional structure metamaterial;

wherein, on the flexible substrate, a structure for strengthening a bonding force between the flexible substrate and formed substrate layers adjacent to the flexible substrate is disposed;

dividing the metamaterial into multiple electromagnetic areas, wherein each electromagnetic area corresponds to one or more electromagnetic parameter ranges; and designing artificial microstructures for one or more electromagnetic parameter ranges of each electromagnetic area so that each electromagnetic area can generate a preset electromagnetic response.

17. The design method according to claim 16, wherein differences between a maximum value and a minimum value of one or more electromagnetic parameter ranges corresponding to each electromagnetic area are equal.

18. The design method according to claim 16, wherein the artificial microstructures in each electromagnetic area have a same topological shape but different sizes.

19. The design method according to claim 16, wherein the artificial microstructures in different electromagnetic areas have different topological shapes.

* * * * *